US007963193B2

(12) United States Patent
Morgan

(10) Patent No.: US 7,963,193 B2
(45) Date of Patent: Jun. 21, 2011

(54) ADJUSTABLE MULTIPLE NAIL HOLDER-EXTENSION

(76) Inventor: John David Morgan, Del Rey Oaks, CA (US)

( * ) Notice: Subject to any disclaimer, the term of this patent is extended or adjusted under 35 U.S.C. 154(b) by 72 days.

(21) Appl. No.: 12/315,170

(22) Filed: Nov. 29, 2008

(65) Prior Publication Data

US 2010/0132514 A1 Jun. 3, 2010

(51) Int. Cl.
*B25C 3/00* (2006.01)

(52) U.S. Cl. ..... 81/44; 81/487

(58) Field of Classification Search ..... 81/44, 23, 81/487, 13

See application file for complete search history.

(56) References Cited

U.S. PATENT DOCUMENTS

| | | | | |
|---|---|---|---|---|
| 239,777 | A * | 4/1881 | Hepfinger | 81/23 |
| 874,613 | A | 12/1907 | McColm | |
| 967,208 | A | 8/1910 | Leslie | |
| 1,200,158 | A * | 10/1916 | Barrett | 81/487 |
| 1,426,249 | A | 8/1922 | Bochonok | |
| 1,572,094 | A * | 2/1926 | Todhunter | 81/44 |
| 1,688,445 | A | 10/1928 | Williams | |
| 2,577,954 | A | 12/1951 | Di Pietro | |
| 2,684,776 | A | 7/1954 | Rosenstein | |
| 2,716,750 | A | 9/1955 | Biblis | |
| 2,878,476 | A | 3/1959 | Auchard | |
| 3,060,442 | A | 10/1962 | Tomek | |
| 3,522,827 | A | 8/1970 | Muller | |
| 3,731,723 | A | 5/1973 | Lemanchec | |
| RE28,159 | E | 9/1974 | Litz | |
| 4,004,624 | A | 1/1977 | Holstein | |
| 4,008,741 | A | 2/1977 | Holstein | |
| 4,079,764 | A | 3/1978 | Hayes | |
| 4,139,036 | A | 2/1979 | Regan et al. | |
| 4,201,258 | A | 5/1980 | Elmore et al. | |
| 4,403,725 | A | 9/1983 | Lawrence | |
| 4,422,489 | A | 12/1983 | Ross | |
| 4,493,353 | A | 1/1985 | Thomas | |
| 4,667,747 | A | 5/1987 | Falls et al. | |
| 4,784,025 | A | 11/1988 | Peck | |
| 4,829,855 | A | 5/1989 | Martinez | |
| 4,926,718 | A | 5/1990 | Cook | |
| 4,966,056 | A | 10/1990 | Miller | |
| 4,967,623 | A | 11/1990 | Jackson | |
| 5,284,070 | A | 2/1994 | Rieck | |
| 5,321,996 | A | 6/1994 | Wei | |
| 5,370,020 | A | 12/1994 | Fifield et al. | |
| 5,375,488 | A | 12/1994 | Baitner | |
| 5,492,262 | A | 2/1996 | Pascarelli | |
| 5,526,723 | A * | 6/1996 | Sormunen et al. | 81/487 |
| D371,286 | S | 7/1996 | Garcia | |
| 5,671,641 | A | 9/1997 | Stephenson | |
| 5,933,894 | A | 8/1999 | Bates | |
| 5,957,007 | A | 9/1999 | Righini | |
| 6,098,498 | A | 8/2000 | Ming et al. | |
| 6,189,415 | B1 | 2/2001 | McQuillin | |
| 6,394,268 | B1 | 5/2002 | Dill et al. | |
| 6,564,681 | B2 | 5/2003 | Coulter | |
| 6,823,990 | B2 | 11/2004 | Gaudron | |
| 7,100,475 | B1 | 9/2006 | Rufolo | |

* cited by examiner

*Primary Examiner* — Hadi Shakeri

(57) ABSTRACT

An improved nail holder that allows the user to safely and comfortably hold a multiplicity of nails while extending his or her reach into hard-to-reach or otherwise inaccessible places. The present invention represents a significant improvement over those inventions disclosed in the prior art in that it: (1) permits the user to hold and position a multiplicity of nails at the same time, (2) provides the user with an ergonomic handle that is comfortable, efficient and safe to hold, (3) extends the reach of the user beyond arm's length and into hard-to-reach or otherwise inaccessible places, and (4) moves the nails held therein horizontally and/or vertically so as to permit operation in additional hard-to-reach or otherwise inaccessible places.

28 Claims, 22 Drawing Sheets

ADJUSTABLE MULTIPLE NAIL HOLDER-EXTENSION

FEDERALLY SPONSORED RESEARCH

Not Applicable

SEQUENCE LISTING OR PROGRAM

Not Applicable

BACKGROUND

1. Field of the Invention

The present invention relates to nail holders, and in particular, nail holders that hold a multiplicity of nails at a distance beyond the user's arm's length.

2. Description of the Prior Art

The construction industry has long voiced a need to mechanically hold nails and brads to avoid injury to the user's fingers. Similarly, the construction industry has long voiced a need to safely and efficiently drive nails of short length, to drive nails in cramped quarters, and to drive nails in hard to reach places. These needs are well documented in the literature of the industry and date back more than a century. Accordingly, a substantial number of practitioners have addressed this problem with varying degrees of success. By way of example, the prior art contains dozens of examples of single, individual nail holders of different sizes and configurations. While these devices offer unique solutions to the problem of holding nails away from the user's fingers, they all have some inherent limitations as discussed below. Specifically, the following U.S. patents disclose nail holders of various types and configurations: U.S. Pat. No. 874,613 issued to McColm (1907); U.S. Pat. No. 1,688,445 issued to Williams (1928); U.S. Pat. No. 2,716,750 issued to Biblis (1955); U.S. Pat. No. 3,060,442 issued to Tomek (1962); U.S. Pat. No. 3,522,827 issued to Muller (1970); U.S. Pat. No. RE 28,159 issued to Litz (1971); U.S. Pat. Nos. 4,004,624 and 4,008,741 issued to Holstein (1977); U.S. Pat. No. 4,079,764 issued to Hayes (1978); U.S. Pat. No. 4,201,258 issued to Elmore et al. (1980); U.S. Pat. No. 4,403,725 issued to Lawrence (1983); U.S. Pat. No. 4,422,489 issued to Ross (1983); U.S. Pat. No. 4,667,747 issued to Falls et. al (1987); U.S. Pat. No. 4,784,025 issued to Peck (1988); U.S. Pat. No. 4,829,855 issued to Martinez (1989); U.S. Pat. No. 4,967,623 issued to Jackson (1990); U.S. Pat. No. 4,926,718 issued to Cook (1990); U.S. Pat. No. 5,321,996 issued to Wei (1994); U.S. Pat. No. 5,370,020 issued to Fifield et al. (1994); U.S. Pat. No. 5,375,488 issued to Baitner (1994); U.S. Pat. No. 5,492,262 issued to Pascarelli (1996); U.S. Design Pat. No. 371,286 issued to Garcia (1996); U.S. Pat. No. 5,761,641 issued to Stephenson (1997); U.S. Pat. No. 5,933,894 issued to Bates (1999); U.S. Pat. No. 5,957,007 issued to Righini (1999); U.S. Pat. No. 6,098,498 issued to Ming et al. (2000); U.S. Pat. No. 6,189,415 issued to McQuillin (2001); and U.S. Pat. No. 7,100,475 issued to Rufolo, Sr. (2006).

While the foregoing prior art represents an impressive array of devices designed to hold a nail away from the user's fingers, it discloses devices that are severely limited in that they typically hold only a single nail. Further, the foregoing prior art discloses devices that must be physically disengaged from the fastener once the user has hammered or set it into place. Further still, the foregoing devices do not contemplate extending the user's reach by any appreciable distance. Further still, most of the foregoing devices are cumbersome, awkward, or uncomfortable to hold for any length of time.

Finally, most of the foregoing devices rigidly hold the fastener in a set location, which prevents the user from placing the fastener in difficult, hard-to-reach locations, especially those at an angle from the device as opposed to directly below or in front of it.

The following U.S. patents disclose nail strips of various types and configurations that attempted to address the problem of holding a single nail: U.S. Pat. No. 967,208 issued to Leslie (1910); U.S. Pat. No. 2,684,776 issued to Rosenstein (1954); U.S. Pat. No. 3,731,723 issued to Lemanchec (1973); U.S. Pat. No. 4,149,036 issued to Regan et al. (1979); U.S. Pat. No. 6,394,268 issued to Dill et al. (2002); and U.S. Pat. No. 6,823,990 issued to Gaudron (2004).

While the foregoing list contains prior art disclosing the use of multiple fasteners, many of the devices holding those fasteners are flexible strips which would necessarily be nailed to the structure into which the nails were driven. Other devices were simply magazines of nails that would be inserted into some type of pneumatic hammering device. As a group, these devices did not address the problem of holding the fastener away from the user's hand. Further, these devices, as a group, did not address the remaining shortcomings found in the nail holders disclosed by the prior art. Specifically, the foregoing prior art disclosed nail strips that contemplated holding more than a single fastener but these devices did not address the need to extend the reach of the user. Further, these devices, like the nail holders disclosed by the prior art, were typically cumbersome, awkward, or uncomfortable to hold for any length of time. Further still, the foregoing devices rigidly hold the fastener in a set location, which prevents the user from placing the fastener in difficult, hard-to-reach locations. Finally, the foregoing devices did not fully address the problem of physically disengaging the device from the fastener once it had been hammered or set in place. The nail holding device still had to be "wiggled" or otherwise maneuvered to disengage it from the nail after the nail had been hammered into place.

The following U.S. patents disclose miscellaneous devices of various types and configurations that do not contemplate the holding of nails but offer unique and creative solutions that could be applied to nail holders and the like:

U.S. Pat. No. 2,577,954 issued to DiPietro (1951) discloses a Nail Set that permits the user to drive a nail below the surface of the material into which it is being hammered. While the device does not hold nails, it does employ the use of a handle to avoid obscuring the work while also lessening the likelihood of injury to the user's fingers.

U.S. Pat. No. 2,878,476 issued to Auchard (1959) discloses a hammer guard for use in placing nails within woodwork without causing hammer marks to appear on the woodwork's surface. The device disclosed by Auchard has a plurality of holes in one end through which the user would drive nails. The device disclosed by Auchard also has a tubular hole in the near end so that the user can hold the hammer guard with his little finger. However, this device does not extend the user's reach, it does not contemplate holding more than one nail at a time, and it does not contemplate access to hard-to-reach places.

U.S. Pat. No. 4,493,353 issued to Thomas (1985) discloses a tool for countersinking nails into a workpiece. While this device contemplates holding one or more nails at a time, it does not extend the reach of the user. Further, the device disclosed by Thomas does not have a multi-planar range of motion. Finally, the device disclosed by Thomas, like so many of the devices disclosed by the prior art, must be physically disengaged from the nail once the nail has been driven or set in place.

U.S. Pat. No. 4,966,056 issued to Miller (1990) discloses a hand-held staple holder that loosely holds a large number of staples in a ready-to-nail position. While this device contemplates holding a large number of fasteners, the staples are loosely held and could fall out if the device were inverted. Further, while this device contemplates the use of a handle, the purpose of the handle appears to be limited to a platform to which the staple holder is attached rather than appreciably extending the user's reach. Finally, the device disclosed by Miller is not designed to permit employment in otherwise inaccessible or hard-to-reach spaces.

U.S. Pat. No. 5,284,070 issued to Rieck (1994) discloses a nailing shield and nail set for use in driving nails. While the device disclosed by Rieck contemplates holding more than one nail for starting purposes, it is limited to three nails by the dimensions of the device. Further, the device disclosed by Rieck must be manually disengaged from the nail after the user has hammered it into place. Further still, the device disclosed by Rieck does not contemplate extending the reach of the user and it does not contemplate movement in different planes to permit use in otherwise inaccessible spaces.

U.S. Pat. No. 6,564,681 issued to Coulter (2003) discloses a nail set holder mounted atop a hollow handle. Coulter does not address the problem of extending the reach of the user. Instead, the handle appears to function as a base for the nail-set holder and a means of keeping the nail-set holder away from the user's hands and fingers. Further, the device disclosed by Coulter does not contemplate holding multiple fasteners nor does it teach movement in one or more planes to permit employment of the device in otherwise inaccessible places.

Taken collectively, all of the foregoing prior art references show that the need to comfortably and safely hold nails to start them or hammer them in hard-to-reach places has been a long-standing and continuing problem for the construction industry. The foregoing prior art presents many unique and innovative solutions to this problem of comfortably and safely holding a single fastener or nail to either start it or hammer it into place. Cumulatively, these devices have made significant headway in addressing these problems. Successive inventors have built upon the lessons learned by their predecessors so as to disclose increasingly sophisticated devices to hold a single nail or other such fastener. That said, there remain several issues and problems that have not been adequately addressed by the prior art, both individually and collectively. In general terms, none of the devices disclosed by the prior art permit the user to comfortably extend his or her reach in multiple directions while simultaneously holding or hammering a multiplicity of fasteners. More specifically:

(1) Most, if not all, of the devices found in the prior art are complex in design and construction and many are difficult and complicated to operate. This makes them expensive to manufacture which, in turn, makes them expensive for the consumer to purchase. Further, these complex designs typically give rise to increasingly larger numbers of breakable parts. The parts must be replaced or the user must purchase an entirely new device either of which represents a significant increase in their cost to the consumer.

(2) Most, if not all, of the devices found in the prior art contain numerous custom-engineered components and parts. This makes these devices expensive because these specially designed components must be engineered and manufactured separately which adds significantly to the cost of such devices. These increased manufacturing costs are necessarily passed on to the consumer. Further, these specially designed or fabricated components typically give rise to increasingly larger numbers of breakable parts which, again, increases the cost of the device to the consumer who must repair or replace the broken parts or purchase a new device altogether.

(3) Most, if not all, of the devices found in the prior art are limited to holding a single fastener. The process of constantly and repetitively inserting individual fasteners is tedious, time-consuming, and inefficient.

(4) Most, if not all, of the devices found in the prior art must be physically disengaged from the fastener once the fastener has been hammered or set in place. The user must typically "wiggle" the device away from the fastener so as to finish hammering it into place. This process is similarly tedious, time-consuming, and inefficient.

(5) Most, if not all, of the devices found in the prior art do not appreciably extend the reach of the user.

(6) Most of the devices disclosed in the prior art rigidly hold a fastener in place making it difficult to hammer or set fasteners in hard-to-reach or otherwise inaccessible locations. While one or two devices disclosed by the prior art contemplate rotational movement of the held fastener, none contemplate movement in multiple planes and none contemplate the rotation of multiple fasteners.

(7) Most of the multiple fastener holders disclosed by the prior art hold the fasteners loosely. As such, the fasteners will fall out if the user tries to use the device in hammering or setting fasteners in other than a horizontal surface.

(8) Most of the multiple fastener holders disclosed by the prior art hold the fasteners at predetermined intervals which limits the placement of such fasteners to those specific intervals.

(9) Most of the multiple fastener holders disclosed by the prior art require the user to attach the holder onto the surface into which the fastener is being hammered or set.

(10) Many of the multiple fastener holders disclosed by the prior art are limited to use with a complex, electric or pneumatic hammering device.

(11) Most, if not all, of the devices disclosed by the prior art and having a handle of some type do not contemplate using the handle to extend the reach of the user. Instead, the handle is merely a structure to which the nail holder is attached.

(12) Most, if not all, of the devices disclosed by the prior art are cumbersome, awkward, and/or uncomfortable to hold for any length of time.

(13) Many of the devices disclosed by the prior art rely on magnetic force to hold the fastener while it is being positioned and set for hammering. Fasteners held in this manner tend to wobble or align themselves obliquely with respect to the holder maker it more difficult to start hammering the fastener properly. Further, these devices are limited to holding a single fastener at a time.

Objects and Advantages. Given the foregoing problems identified in the prior art, the present invention provides the user with the capability of holding a multiplicity of nails in place for hammering beyond the reach of the user's arms-length. Besides avoiding potential injuries to the user's fingers this device also permits the user to continue hammering a number of fasteners beyond arm's length without having to stop hammering to reload the nail holder as is the case with the nail holders disclosed by the prior art. By holding more than one nail at a time, the present invention saves the user time and money by eliminating the reloading step taught by the prior art. Specifically, the object of the present invention is:

(1) to provide an adjustable multiple nail holder-extension that is simple to construct, economical in price and easy to use.

(2) to provide an adjustable multiple nail holder-extension that has a minimum number of moving parts.

(3) to provide an adjustable multiple nail holder-extension that is capable of holding a single nail or more than one nail at a time.

(4) to provide an adjustable multiple nail holder-extension that holds a multiplicity of nails at one time.

(5) to provide an adjustable multiple nail holder-extension that extends the reach of the user to permit hammering of nails and other such fasteners beyond arm's length.

(6) to provide an adjustable multiple nail holder-extension that facilitates hammering nails in an overhead location.

(7) to provide an adjustable multiple nail holder-extension that permits rotational movement of the held nails in a horizontal plane and/or a vertical plane.

(8) to provide an adjustable multiple nail holder-extension that facilitates hammering nails in hard-to-reach or otherwise inaccessible places.

(9) to provide an adjustable multiple nail holder-extension with an ergonomic handle that is comfortable and efficient to hold, especially for extended periods of time.

(10) to provide an adjustable multiple nail holder-extension that does not have to be physically disengaged from the fastener once the fastener has been set or hammered into place.

(11) to provide an adjustable multiple nail holder-extension that increases the user's efficiency by eliminating the need to repetitively place single nails or other such fasteners into the device.

Additional objects, advantages, and novel features of the invention will be set forth in part of the description which follows and will become apparent to those skilled in the art upon examination of the following specification, or will be learned through the practice of the present invention.

SUMMARY

The present invention is an improved nail holder that allows the user to safely and comfortably hold a multiplicity of nails so as to extend his or her reach into hard-to-reach or otherwise inaccessible places. The present invention represents a significant improvement over those inventions disclosed in the prior art by:

(1) Holding a multiplicity of nails at the same time.

(2) Providing the user with an ergonomic handle that is comfortable, efficient and safe to hold.

(3) Extending the reach of the user beyond arm's length.

(4) Extending the reach of the user into hard-to-reach or otherwise inaccessible places.

(5) Moving the held nails horizontally and/or vertically so as to permit operation in hard-to-reach or otherwise inaccessible places.

These improvements provide the user with a device that is easier to operate and more affordable than similar devices disclosed by the prior art. The present invention is simple in design and construction which makes it easy to use and economical to manufacture. The present invention uses many off-the-shelf components, which, again, makes it economical to manufacture. The present invention is adaptable to nails of all sizes and types which are made from ferrous, magnetic, or other such materials. The present invention can be used to drive nails into any nailable material at any angle and from any direction.

DRAWINGS

Drawing Figures

Figure 11:
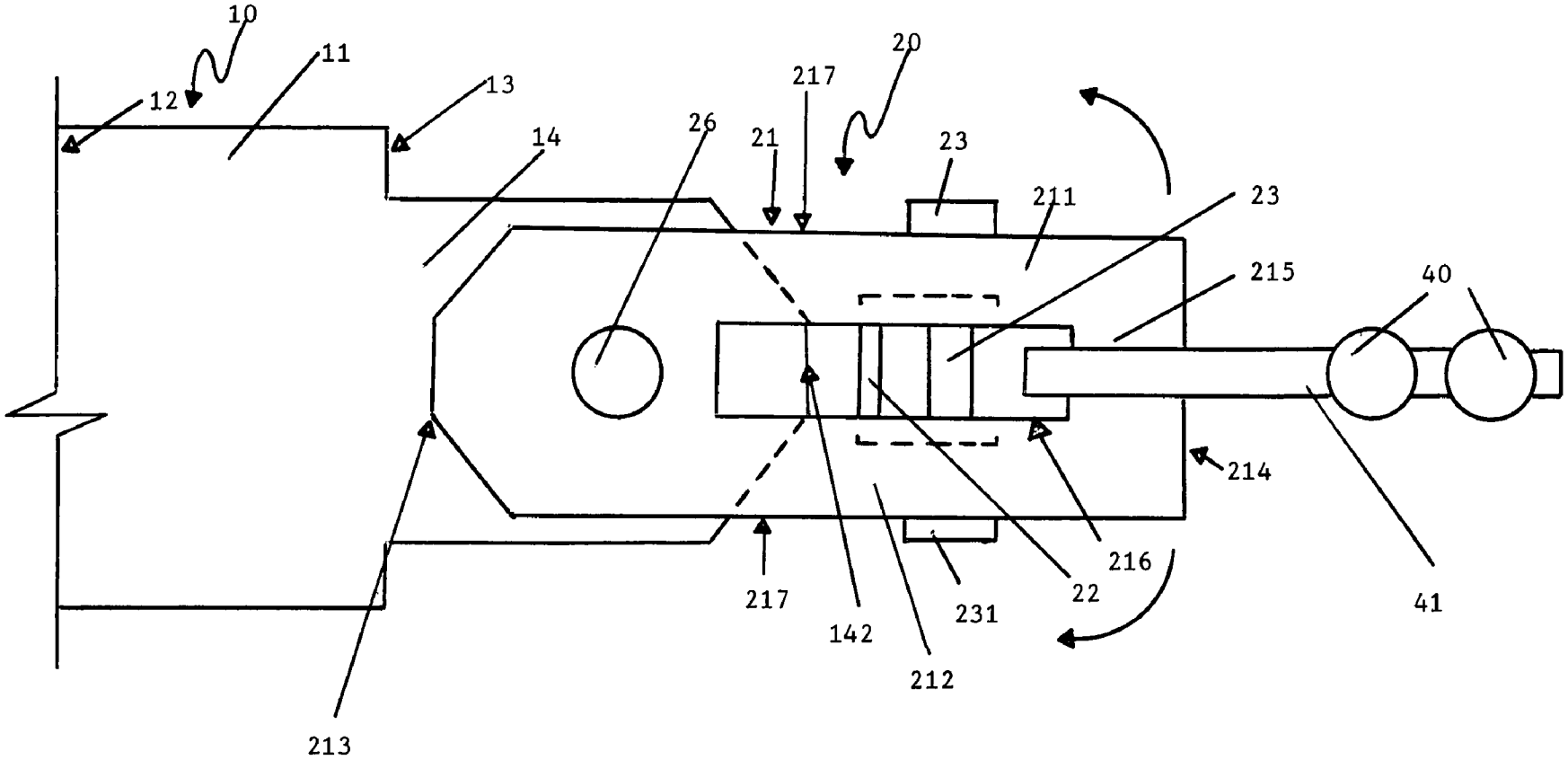
FIG. 11 is a top-down plan view of an alternative (horizontal rotation) embodiment.
Figure 11A:
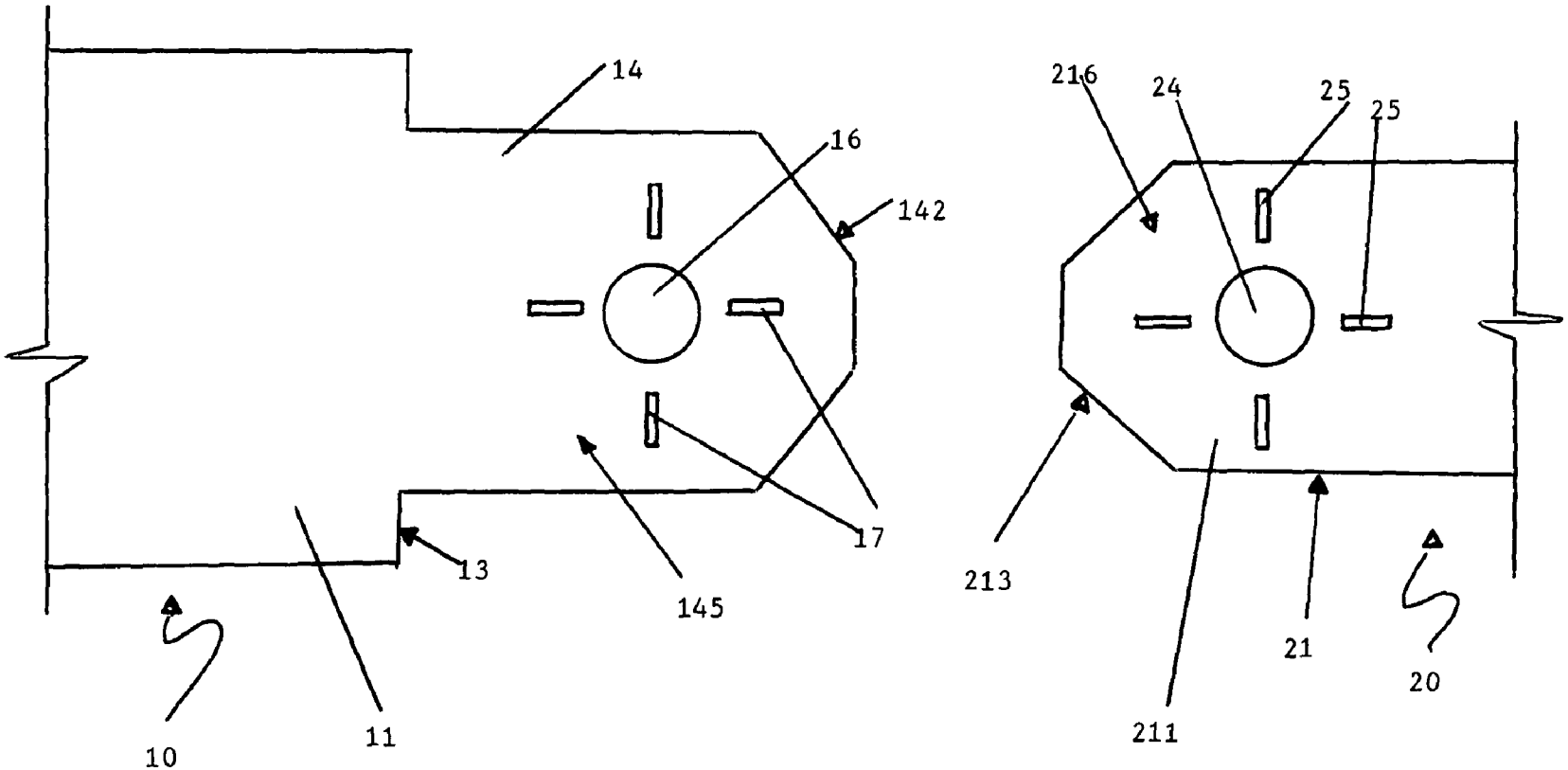

FIG. 11*a* is shows the top surface of the stationary mounting bar and the inner surface of the proximal end of the upper leg of the nail holding plate on the alternative (horizontal rotation) embodiment.

Figure 11B:
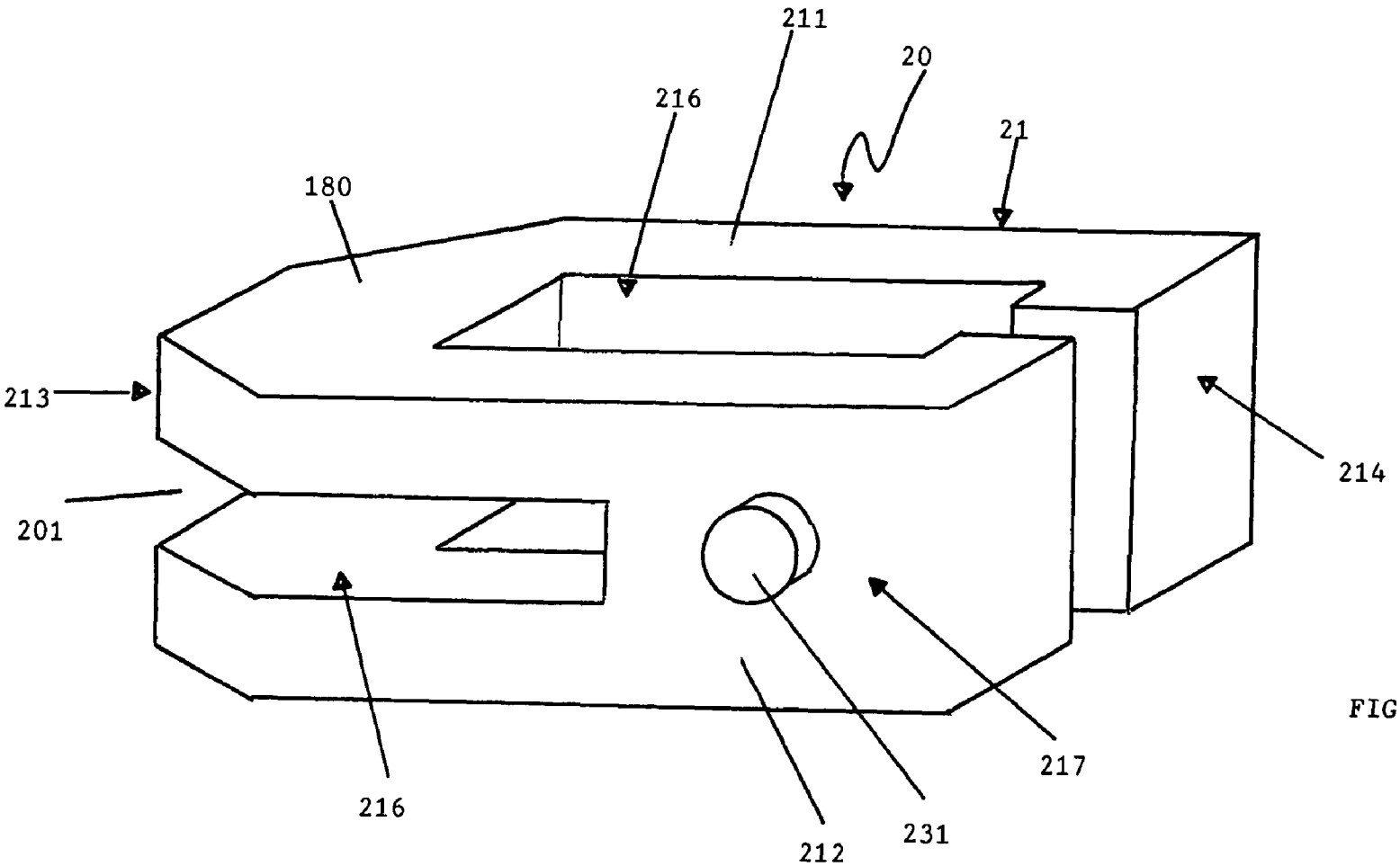

FIG. 11*b* is a perspective view of the nail holding plate in the alternative (horizontal rotation) embodiment.

Figure 11C:
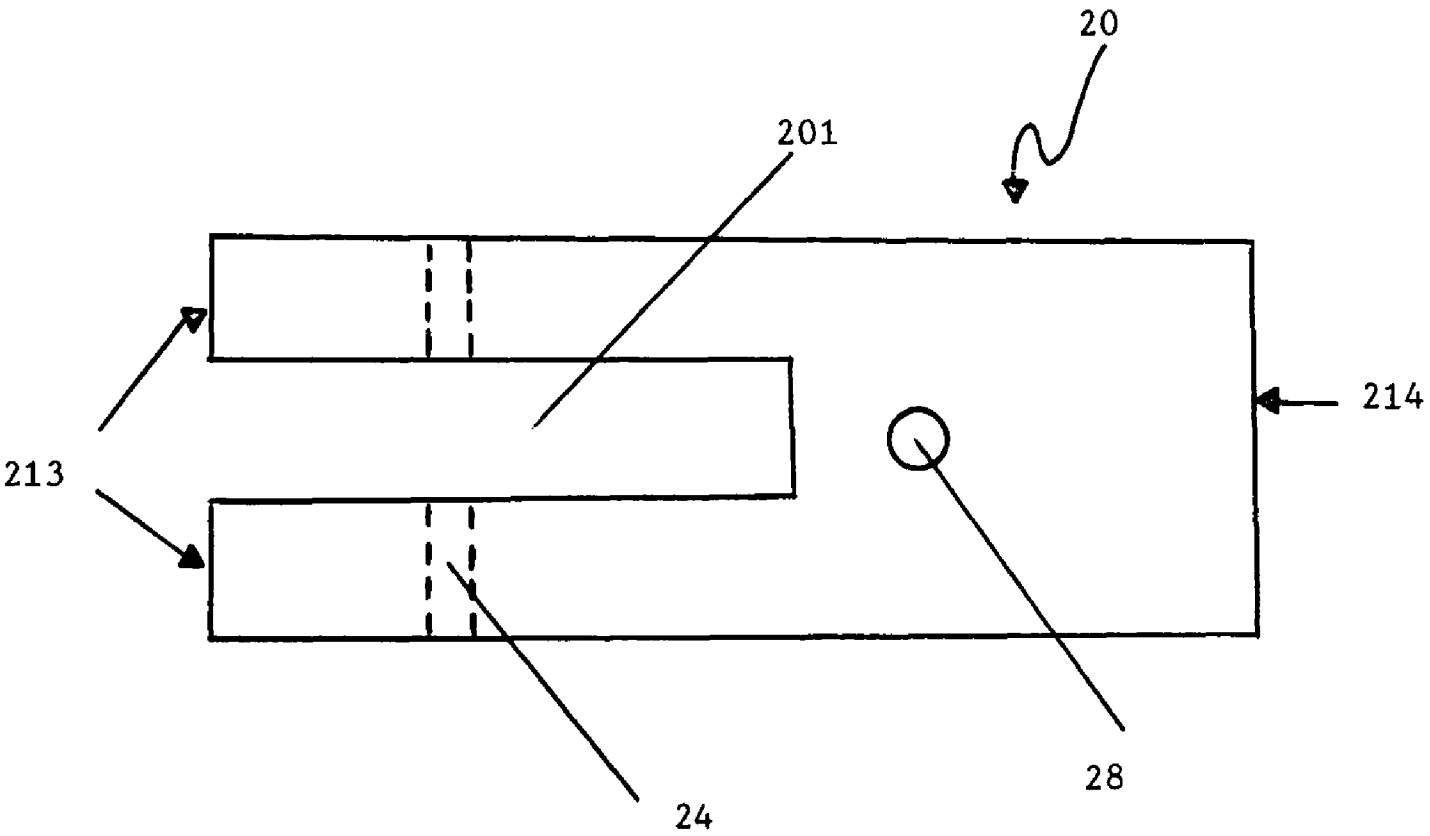

FIG. 11*c* is a side view of the nail holding plate in the alternative (horizontal rotation) embodiment.

Figure 12:
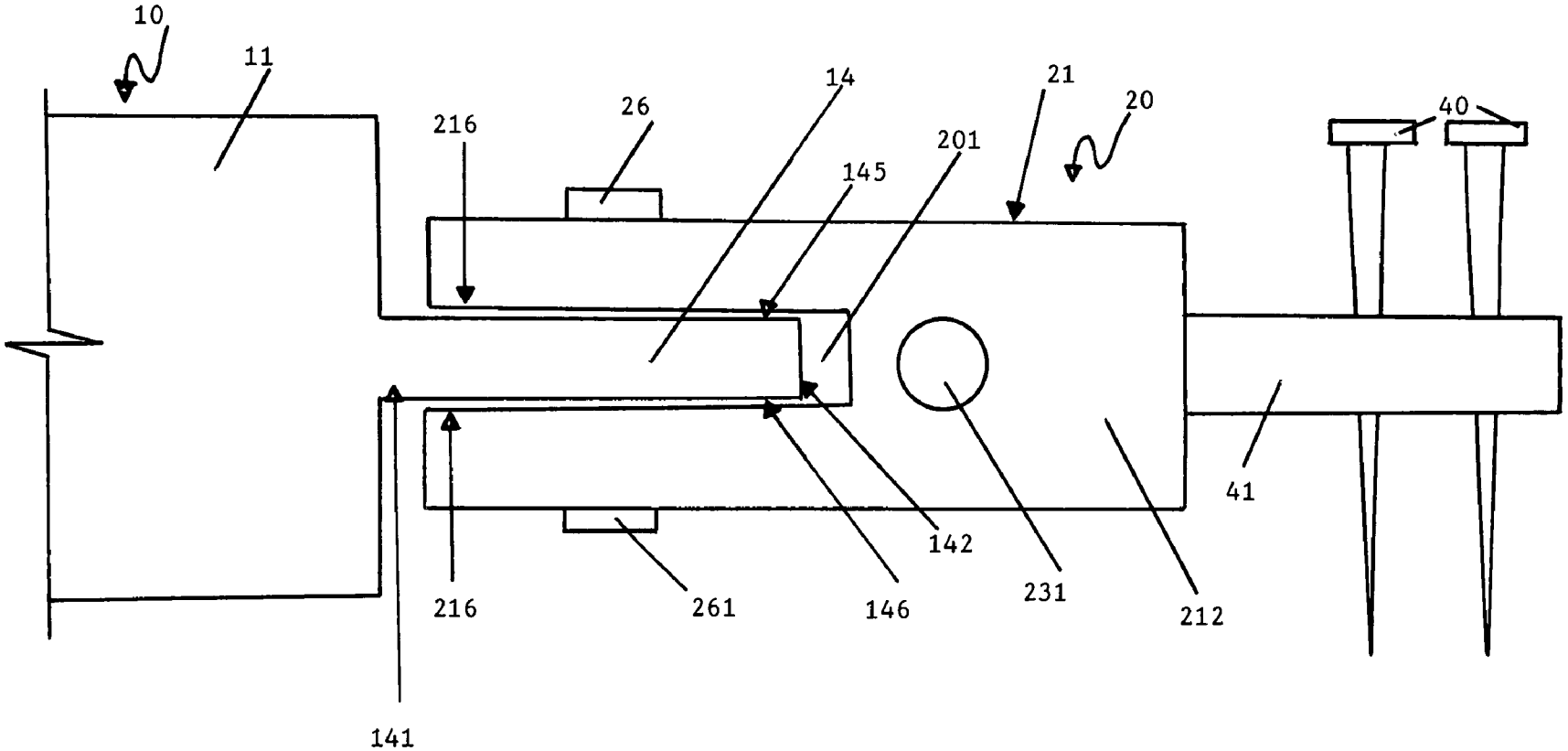

FIG. 12 is a side view of an alternative (horizontal rotation) embodiment.

Figure 13:
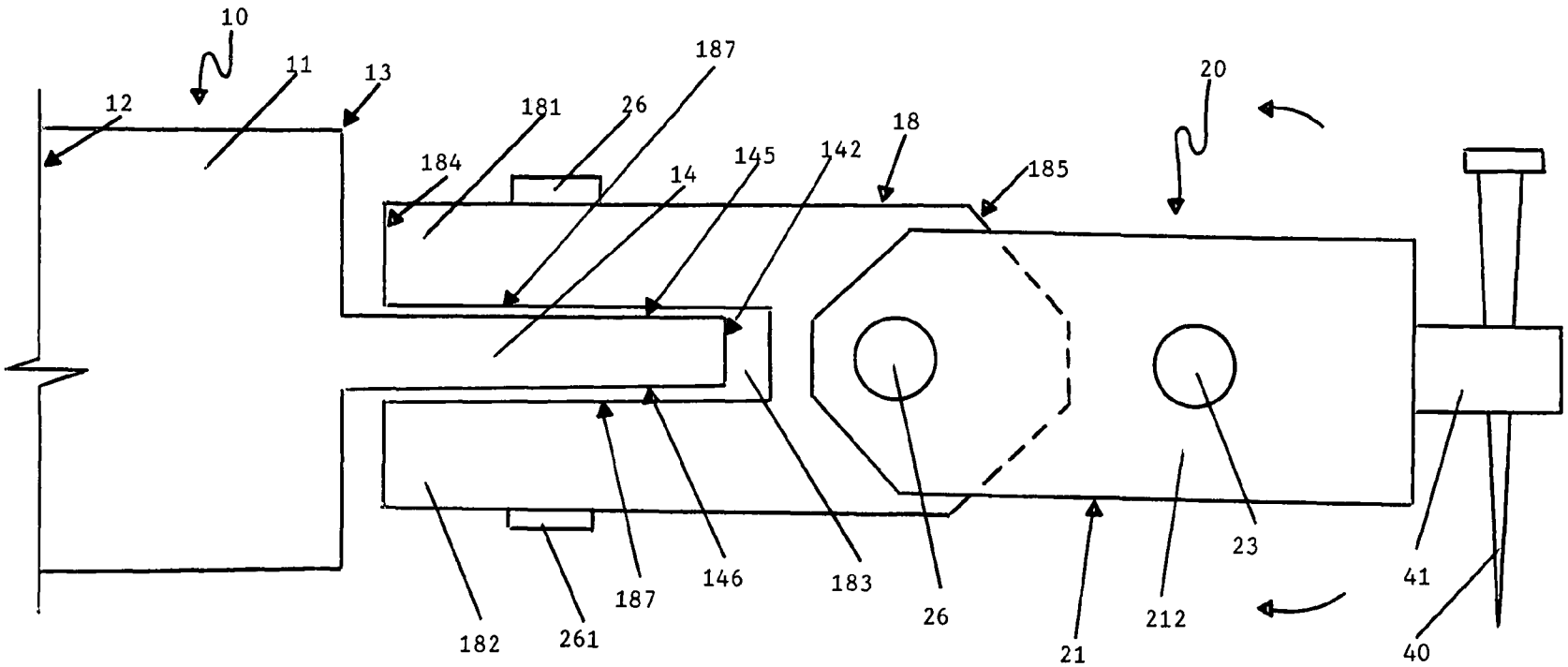

FIG. 13 is a top-down plan view of the preferred embodiment.

Figure 13A:
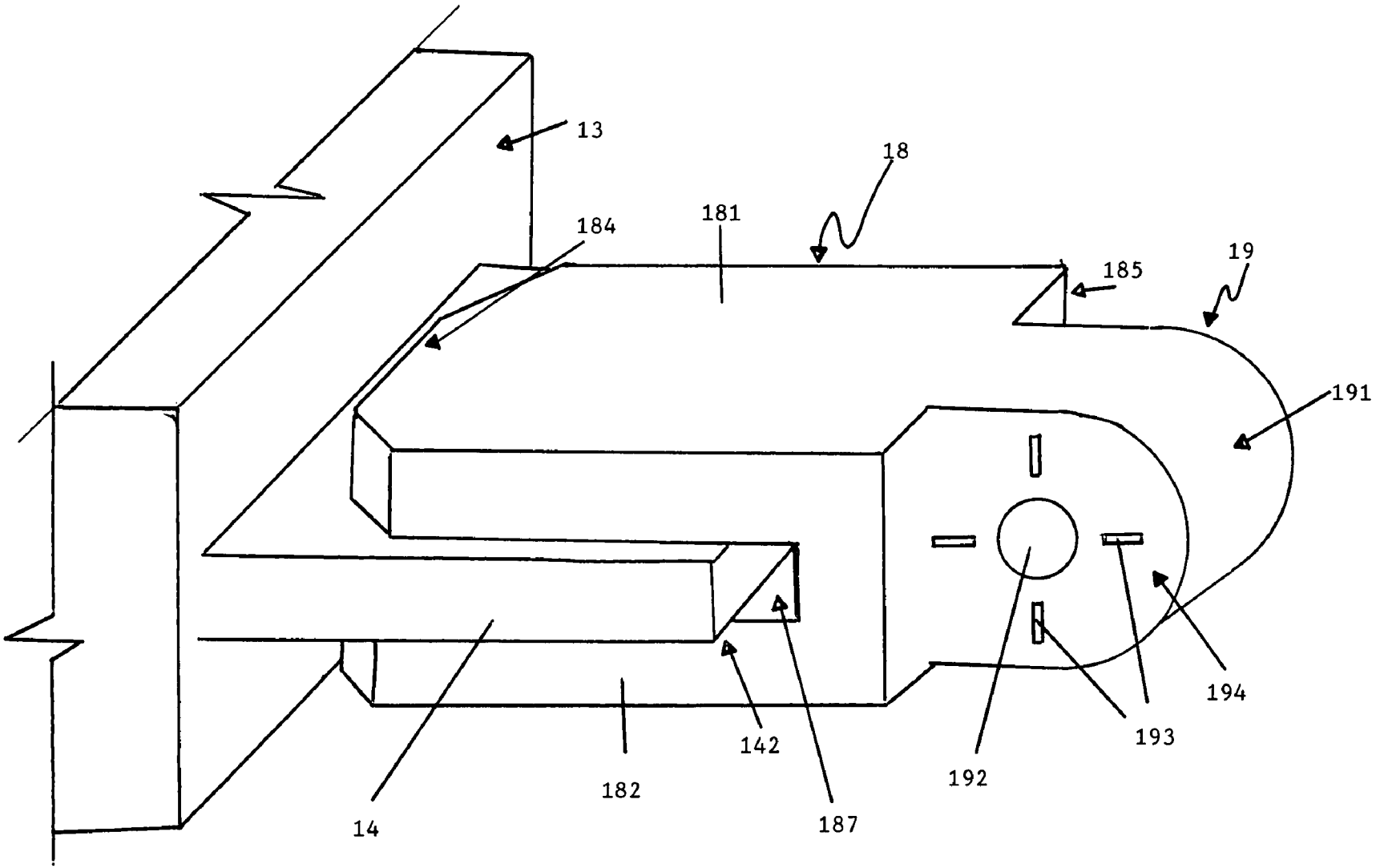

FIG. 13*a* is a perspective view of the movable mounting bar found on the preferred embodiment.

Figure 13B:
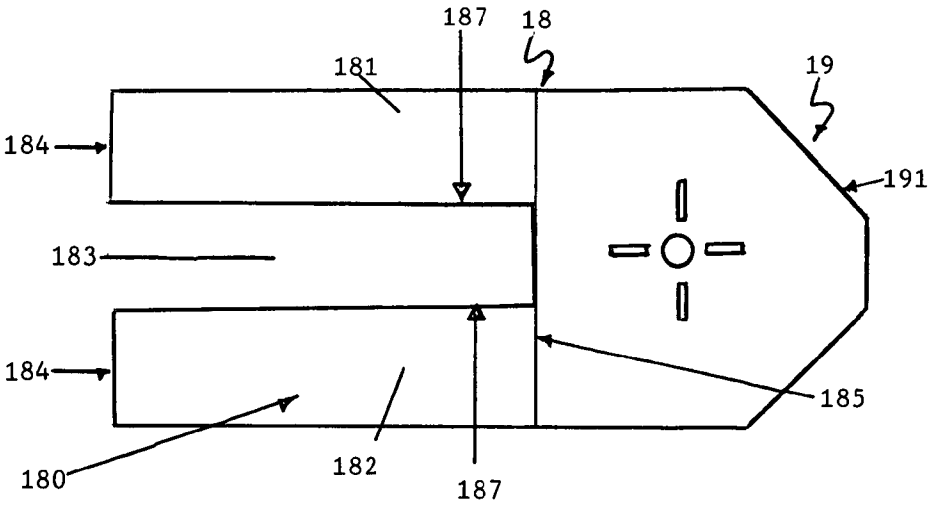

FIG. 13*b* is a side view of the movable mounting bar found on the preferred embodiment.

Figure 13C:
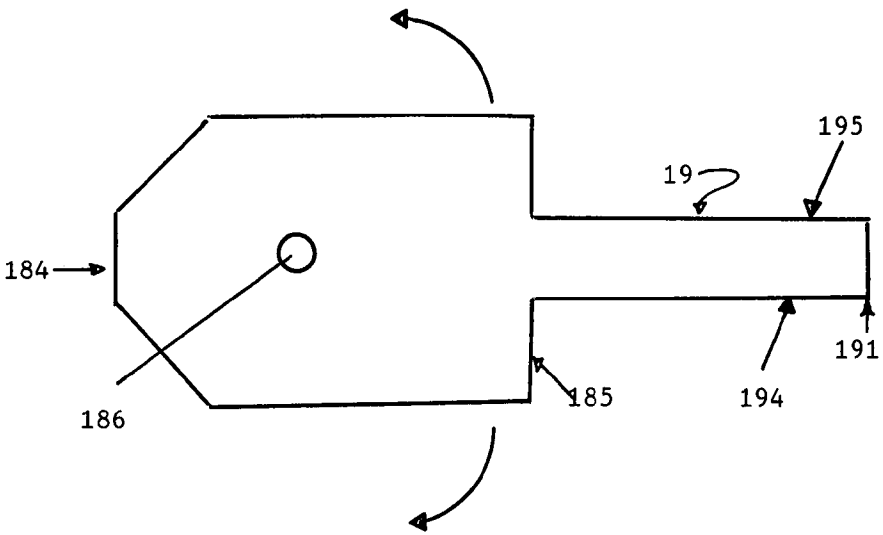

FIG. 13*c* is a top-down plan view of the movable mounting bar found on the preferred embodiment.

Figure 13D:
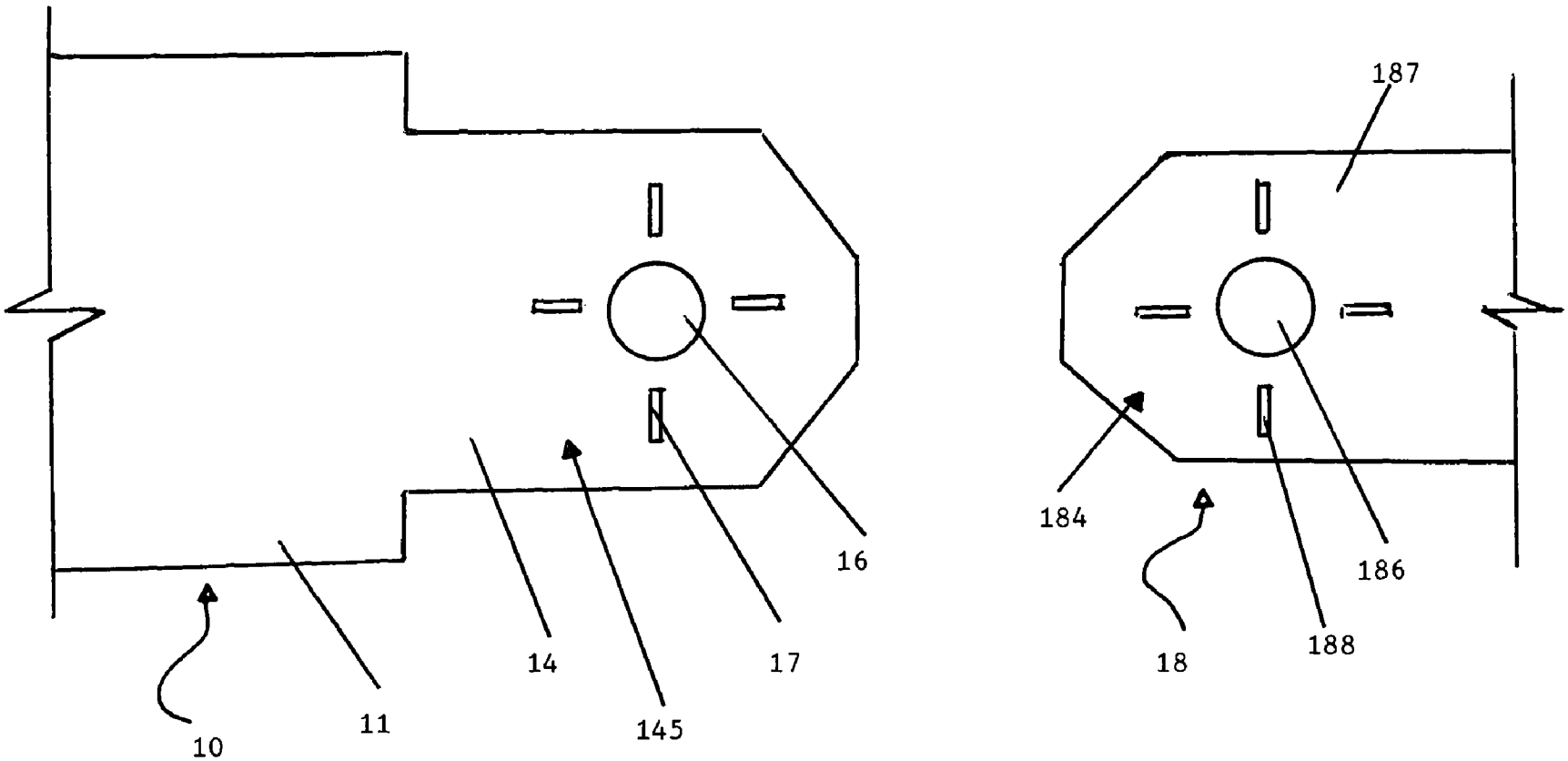

FIG. 13*d* is a detail showing the groove and notch alignment on the preferred embodiment.

Figure 13E:
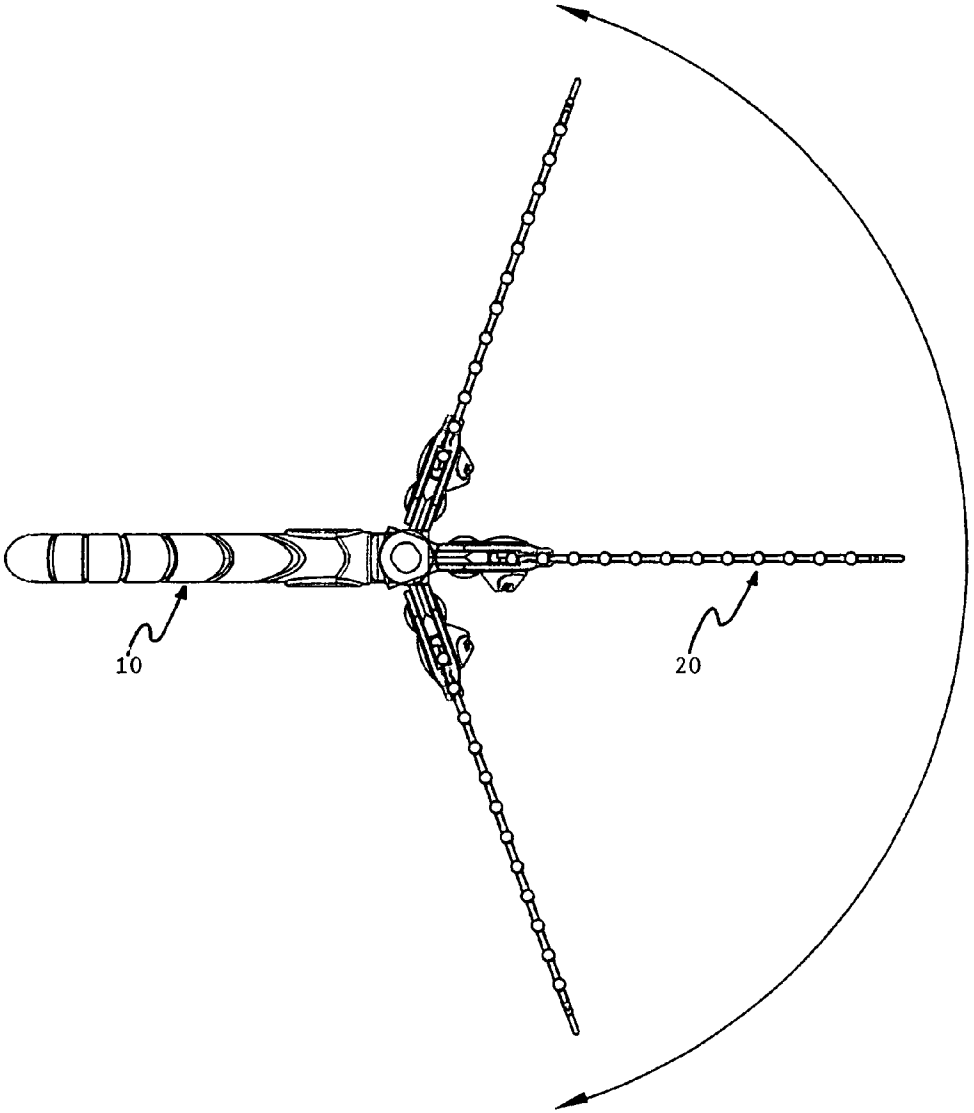

FIG. 13*e* is a top-down plan view of the preferred embodiment showing rotation in a horizontal plane.

Figure 14:
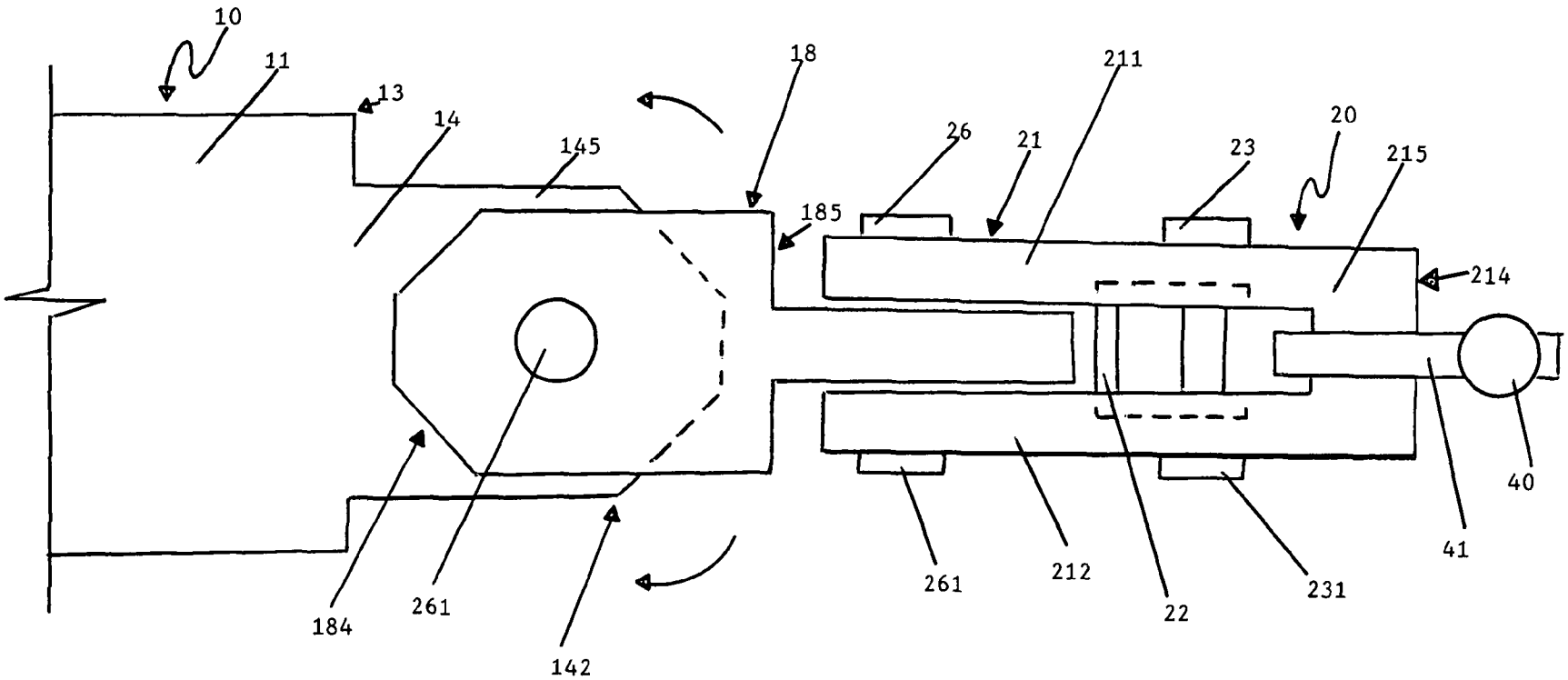

FIG. 14 is a side view of the preferred embodiment.

Figure 15:
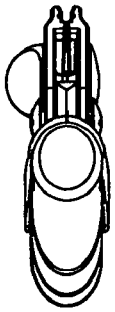

FIG. 15 is a proximal end view of an alternative embodiment (vertical rotation) with an ergonomic handle.

Figure 16:
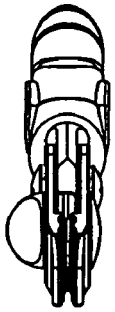

FIG. 16 is a distal end view of an alternative embodiment (vertical rotation) with an ergonomic handle.

Figure 17:
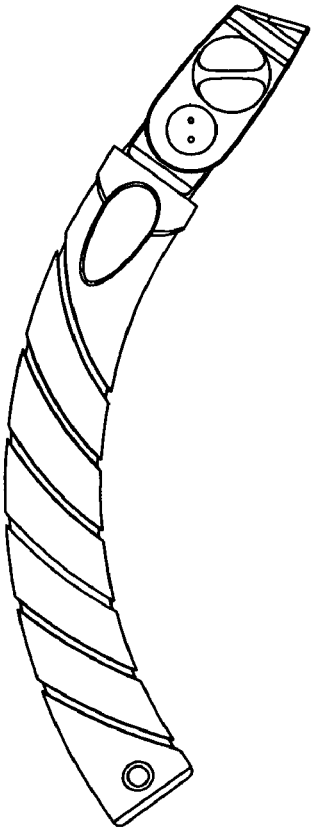

FIG. 17 is a right-side elevation view of an alternative (vertical rotation) embodiment with an ergonomic handle.

Figure 18:
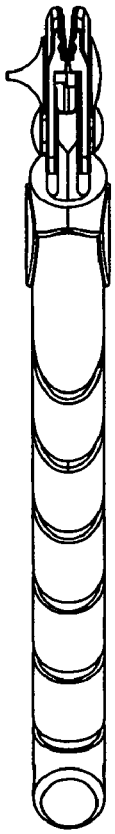

FIG. 18 is a top-down plan view of an alternative embodiment (vertical rotation) with an ergonomic handle.

Figure 19:
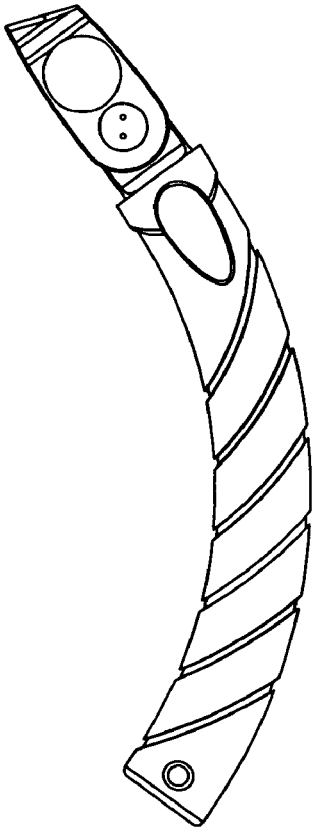

FIG. 19 is a left-side elevation view of an alternative (vertical rotation) embodiment with an ergonomic handle.

REFERENCE NUMERALS IN DRAWINGS

10—Handle Assembly
11—Handle
12—Proximal End
13—Distal End
187—Movable Mounting Bar Leg Inner Surface
188—Positioning Notch

19—Second Stationary Mounting Bar
191—Distal End of Second Stationary Mounting Bar
192—Positioning Hole
193—Grooves
194—Right Side of Second Stationary Mounting Bar
195—Left Side of Second Stationary Mounting Bar
20—Nail-holding Assembly
201—Slot
21—Nail-holding Plate
211—Left Nail-holding Plate
212—Right Nail-holding Plate
213—Rounded Proximal End of Nail-holding Plate
214—Distal End of Nail-holding Plate
215—Gripping Surface
216—Nail-holding Plate Inner Surface
217—Nail-holding Plate Outer Surface
22—Separator
14—Stationary Mounting Bar
141—Proximal End of Stationary Mounting Bar
142—Distal End of Stationary Mounting Bar
143—Right Side of Stationary Mounting Bar
144—Left Side of Stationary Mounting Bar
145—Top Surface of Stationary Mounting Bar
146—Bottom Surface of Stationary Mounting Bar
15—Attaching Pin
151—Attaching Pin Cap
16—Positioning Hole
17—Groove
18—Movable Mounting Bar
180—U-Shaped Block
181—Upper Leg of Movable Mounting Bar
182—Lower Leg of Movable Mounting Bar
183—Slot
184—Proximal End of Movable Mounting Bar
185—Distal End of Movable Mounting Bar
186—Positioning Hole
221—Separator Leg
222—Tightening Hole
23—Tightening Pin
231—Tightening Pin Cap
24—Positioning Hole
25—Positioning Notch
26—Pivot Pin
261—Pivot Pin Cap
27—Wavy Washer
28—Tightening Hole
40—Nail
41—Breakable Nail Strip

DESCRIPTION OF THE INVENTION

Description—Simplest Embodiment

Figure 1:
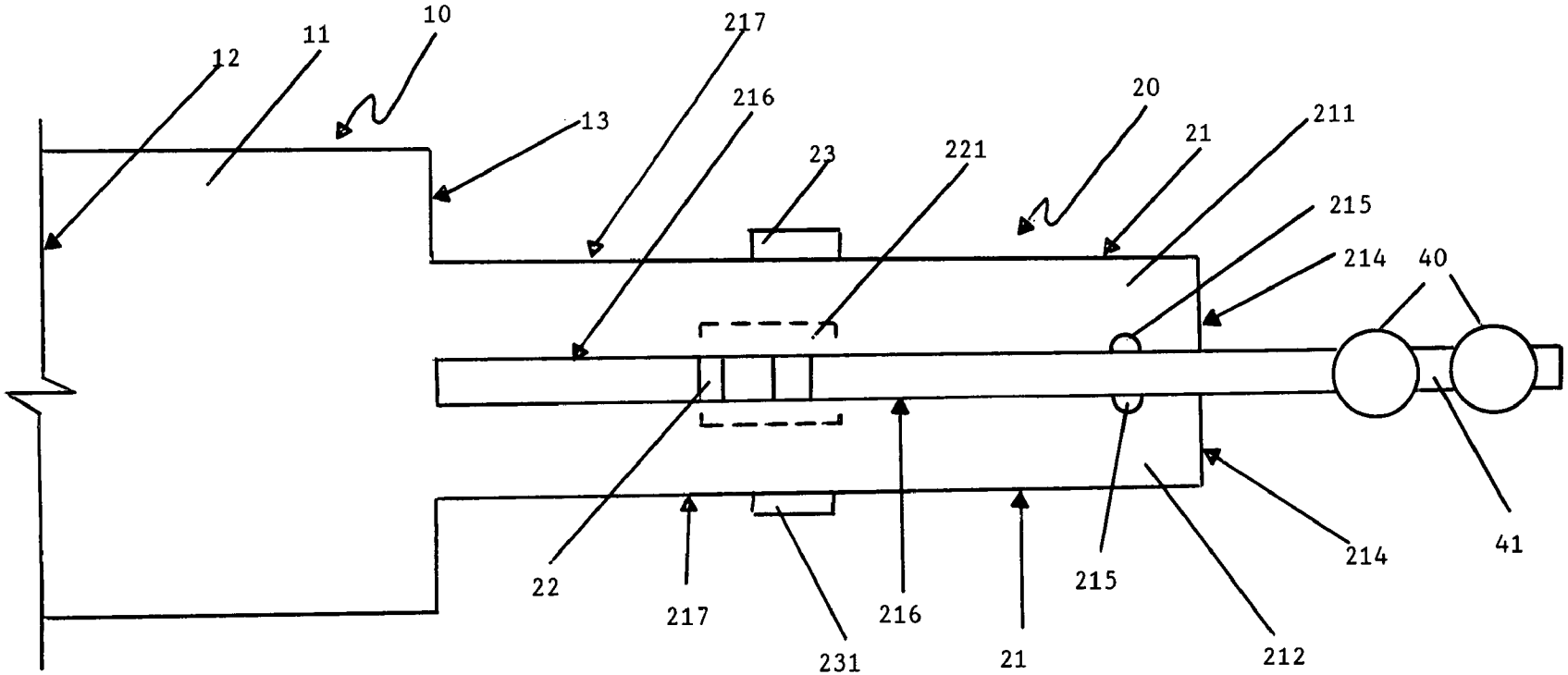
FIG. 1 is a top-down plan view of the simplest embodiment.
Figure 2:
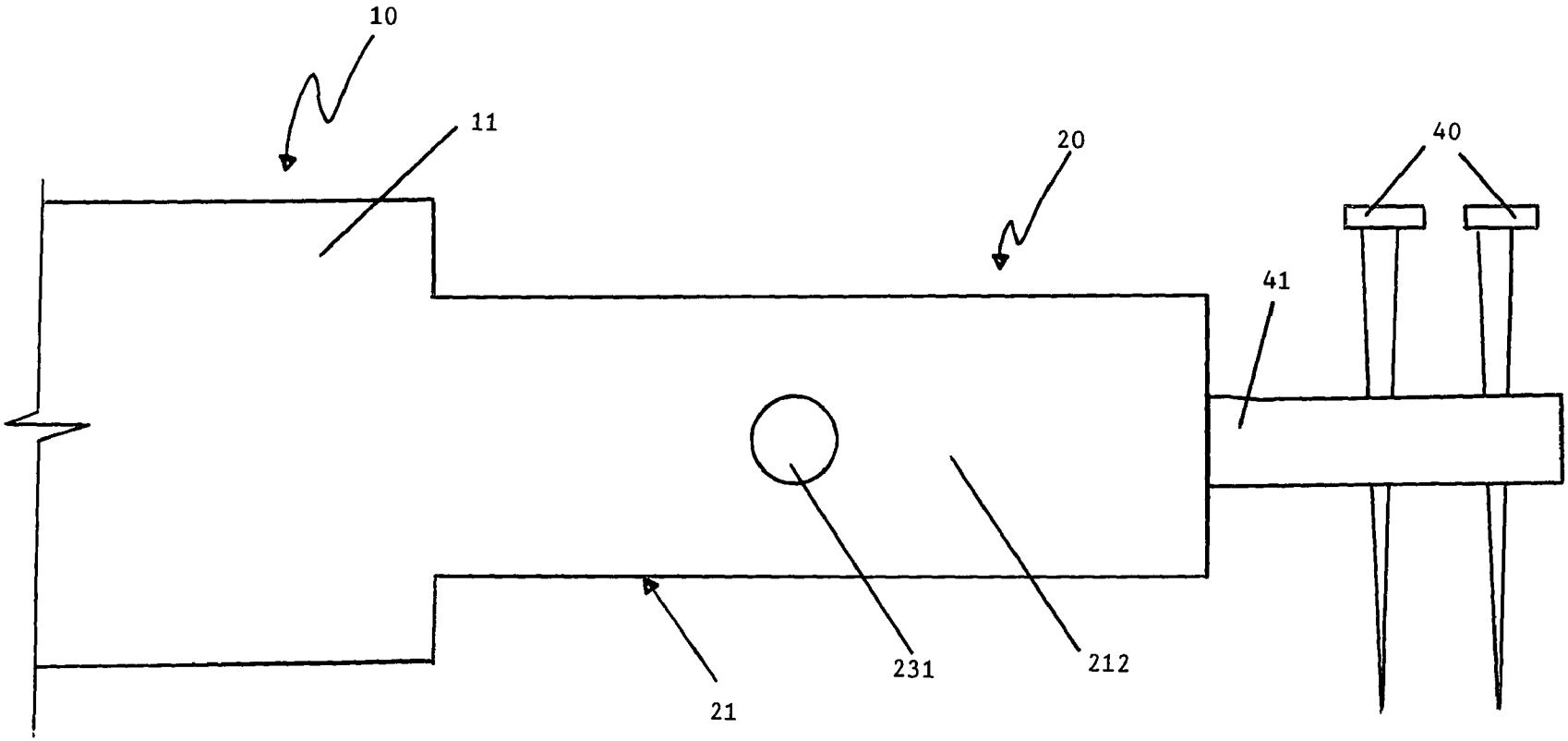
FIG. 2 is a side view of the simplest embodiment.

The simplest embodiment of the present invention allows the user to position a single nail or a multiplicity of nails for hammering well beyond arm's length. Referring to FIGS. 1 and 2, the simplest embodiment of the present invention is comprised of a handle assembly 10 and a closeable nail-holding assembly 20 that can hold a single nail 40 or a breakable nail strip 41 containing a multiplicity of nails 40. The handle assembly 10 consists of a uniformly cast and generally cylindrical solid handle 11 having a proximal end 12 and a distal end 13. The nail-holding assembly 20 consists of two generally rectangular solid nail-holding plates 21 with a vertical proximal end 213 and an angled or vertical distal end 214. These nail-holding plates are parallel to one another and extend perpendicularly from the distal end 13 of the handle 11. The handle 11 and nail-holding plates 21 are typically cast or extruded as a single piece to maximize the strength and durability of the device. Casting these components separately and/or from different materials and then firmly and permanently inserting the nail-holding plates 21 into the distal end 13 of the handle 11 is an option that affords the user flexibility on materials and mode of assembly.

The handle 11 and nail-holding plates 21 are composed of a lightweight, non-deformable, and durable material that can be easily cast or extruded. Accordingly, materials such as a hard rubber or plastic compound, nylon, aluminum, composite material, and the like would be suitable choices.

While the length of the handle 11 can vary from user to user, an overall length in the range of 10 inches to 16 inches is considered optimal to extend the reach of the user as contemplated by this invention. A handle 11 as short as four inches might also be desirable to simply position a multiplicity of nails 40 just beyond the reach of the user while affording the user more control over the positioning of the nails 40.

The simplest embodiment of the present invention contemplates a straight, generally cylindrical handle 11. Alternative designs for the simplest embodiment as well as all of the alternative embodiments contemplate a curved handle 11 with an oval-shaped cross section. FIGS. 7 and 15-19 give various views and perspectives of this curved handle 11. The curved handle 11 provides the user with a handle 11 that is comfortable to grasp and hold for long periods of time thereby making it an ergonomically efficient building construction or carpentry tool.

The nail-holding assembly 20 consists of two nail-holding plates 21: a left nail-holding plate 211 and a right nail-holding plate 212 separated by a U-shaped elastic separator 22 with its legs 221 embedded or laying flush against the nail-holding plates 21 (211,212) and pointing toward the distal ends 214 of the nail-holding plates 21 (211,212). The inherent elasticity of the material composing the separator 22 tends to push the nail-holding plates 21 apart. Accordingly, materials such as, without limitation, stainless steel, a hardened rubber, or a hard, resilient plastic would be suitable choices for the separator 22. A threaded tightening pin 23 extends all the way through the left nail-holding plate 211 near its distal end 214, through tightening holes 222 (see FIG. 8) drilled in both separator legs 221, and all the way through the right nail-holding plate 212 near its distal end 214. The threaded tightening pin 23 screws into a threaded tightening pin cap 231 positioned on the outer surface 217 of the right nail-holding plate 212. While the tightening pin 23 and the tightening pin cap 231 are typically composed of stainless steel, numerous alternative materials including, without limitation, chrome-plated metals, plastic, hardened rubber, and the like are also suitable alternatives.

Screwing the tightening pin 23 into the tightening pin cap 231 moves the nail-holding plates 21 (211, 212) together while unscrewing the tightening pin 23 from the tightening pin cap 231 allows the separator 22 to move the nail-holding plates 21 (211,212) apart. FIG. 1 shows the separator legs 221 embedded or otherwise set in the inner surface 216 of both nail-holding plates 21 (211,212). This configuration provides a more secure placement of the separator 22 in the nail holding plates 21 (211,212). Another option is to have the separator legs 221 flush against the inner surfaces 216 of the nail-holding plates 21.

Figure 8:
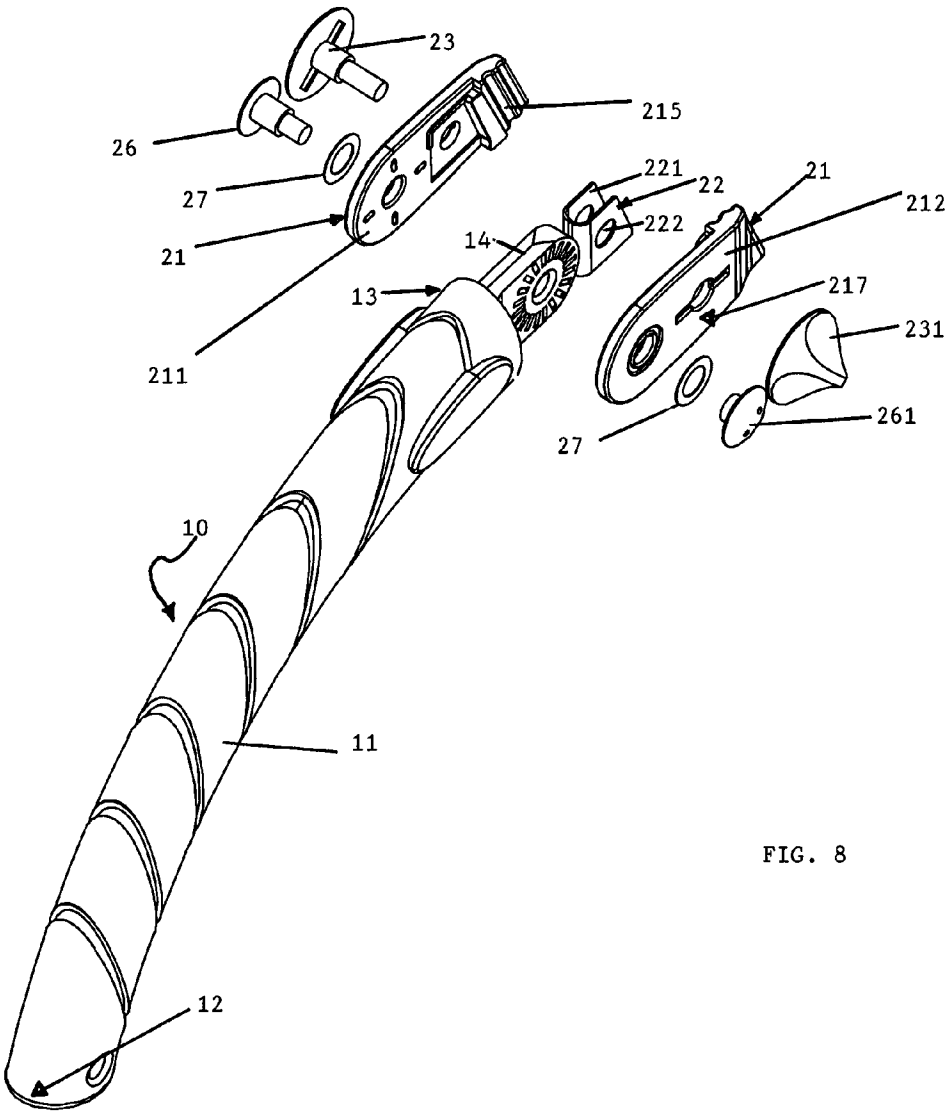
FIG. 8 is an exploded perspective view of an alternative embodiment (vertical rotation) with an ergonomic handle.
Figure 9:
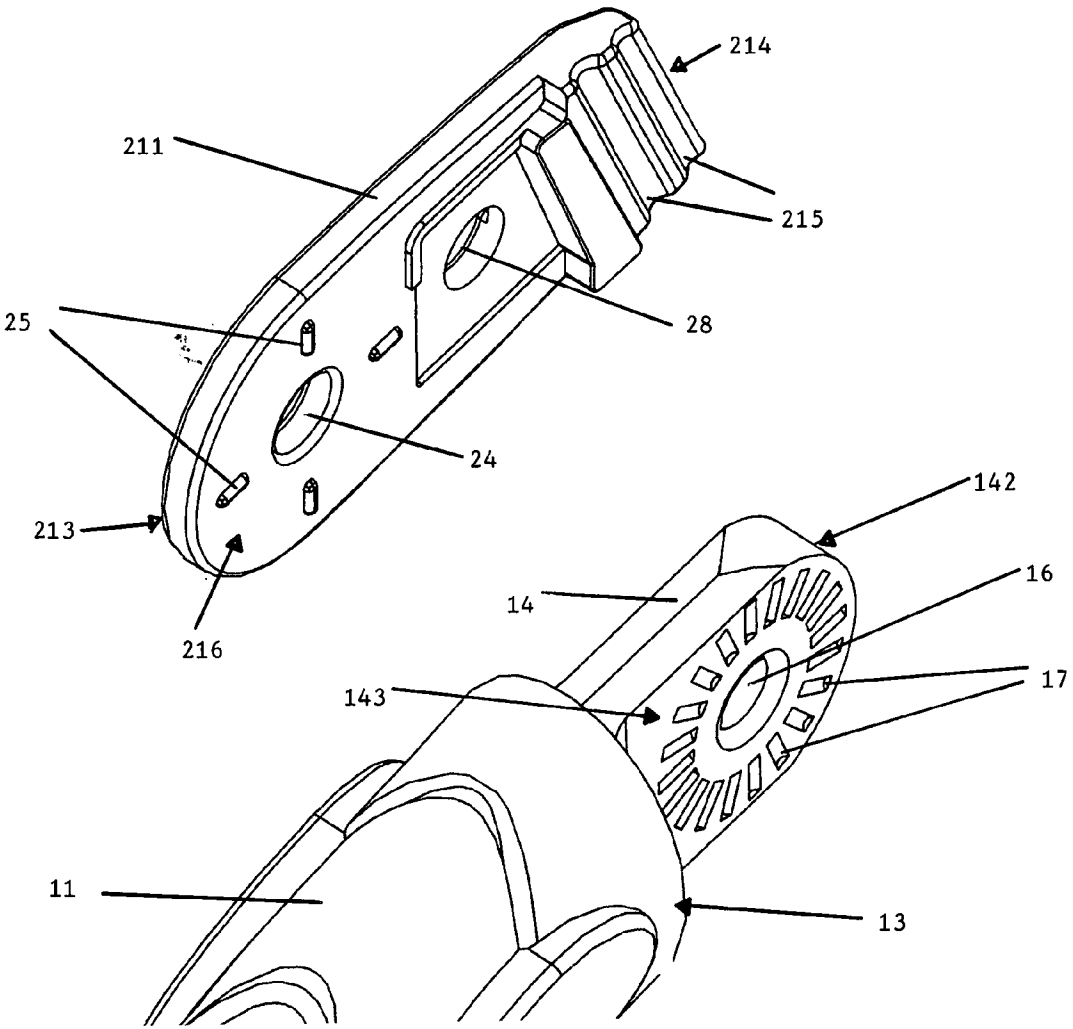
FIG. 9 is a magnified exploded perspective view of an alternative (vertical rotation) embodiment showing the nail holding plate and the stationary mounting bar.

A gripping surface 215 on the inner surface 216 of each nail-holding plate's 21 (211,212) distal end 214 securely holds the nail 40 or the nail strip 41 so that the nail 40 or the nail strip 41 will not fall out of the nail-holding plates 21 (211,212) as the nails 40 are being hammered. The gripping surface 215 on this simplest embodiment, as well as all alternative embodiments and the preferred embodiment, is typically a series of grooves or other such indentations that have been machined or cut into the inner surface 216 of each nail-holding plate's 21 (211,212) distal end 214. The grooves or indentations defining the gripping surface 215 are dimensioned so as to fit snugly and securely around an individual nail 40 or the last nail 40 in a typical, commercially available, breakable nailing strip 41. FIG. 8 and FIG. 9 show the gripping surface in more detail while FIG. 13*e* sows how the gripping surface 215 would hold the last nail 40 in a typical, commercially available, breakable nailing strip 41.

Figure 10:
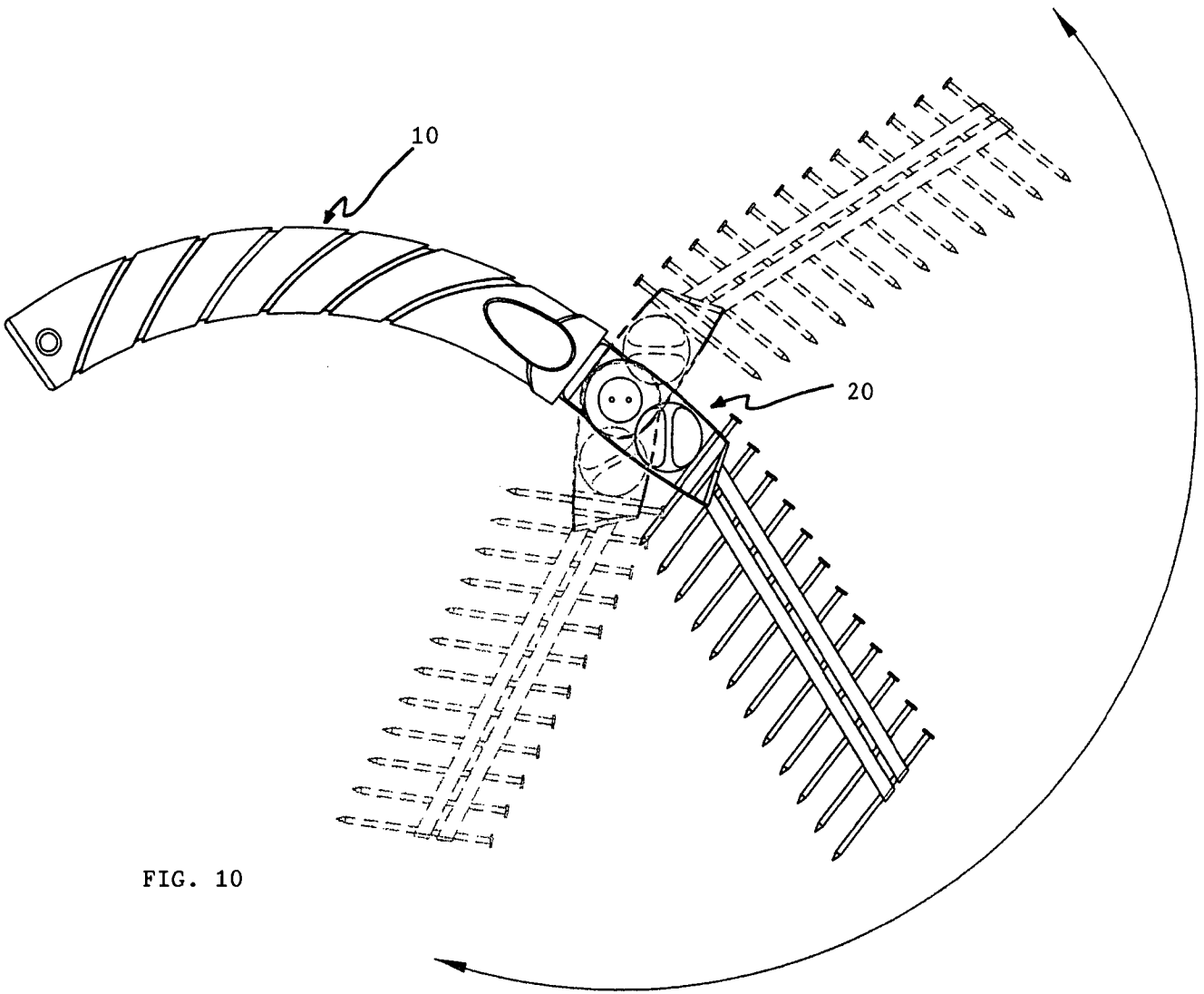
FIG. 10 is a side view of an alternative (vertical rotation) embodiment showing rotation in a vertical plane.

Typically, a carpenter will position nails 40 at a 90 degree angle (perpendicular) to the surface into which they will be hammered. However, nails 40 mounted or otherwise disposed in a breakable nail strip 41 are often mounted at an angle. To accommodate such a configuration, the distal end 214 of the nail-holding plate 21 can be angled (as shown in FIGS. 9 and 10) so as to vertically align nails 40 that are angularly disposed in a breakable nail strip 41. This simplest embodiment can also be constructed to accommodate nails 40 that are vertically disposed in a nail strip 41 by aligning the distal end 214 vertically as is shown in FIG. 2.

Figure 3:
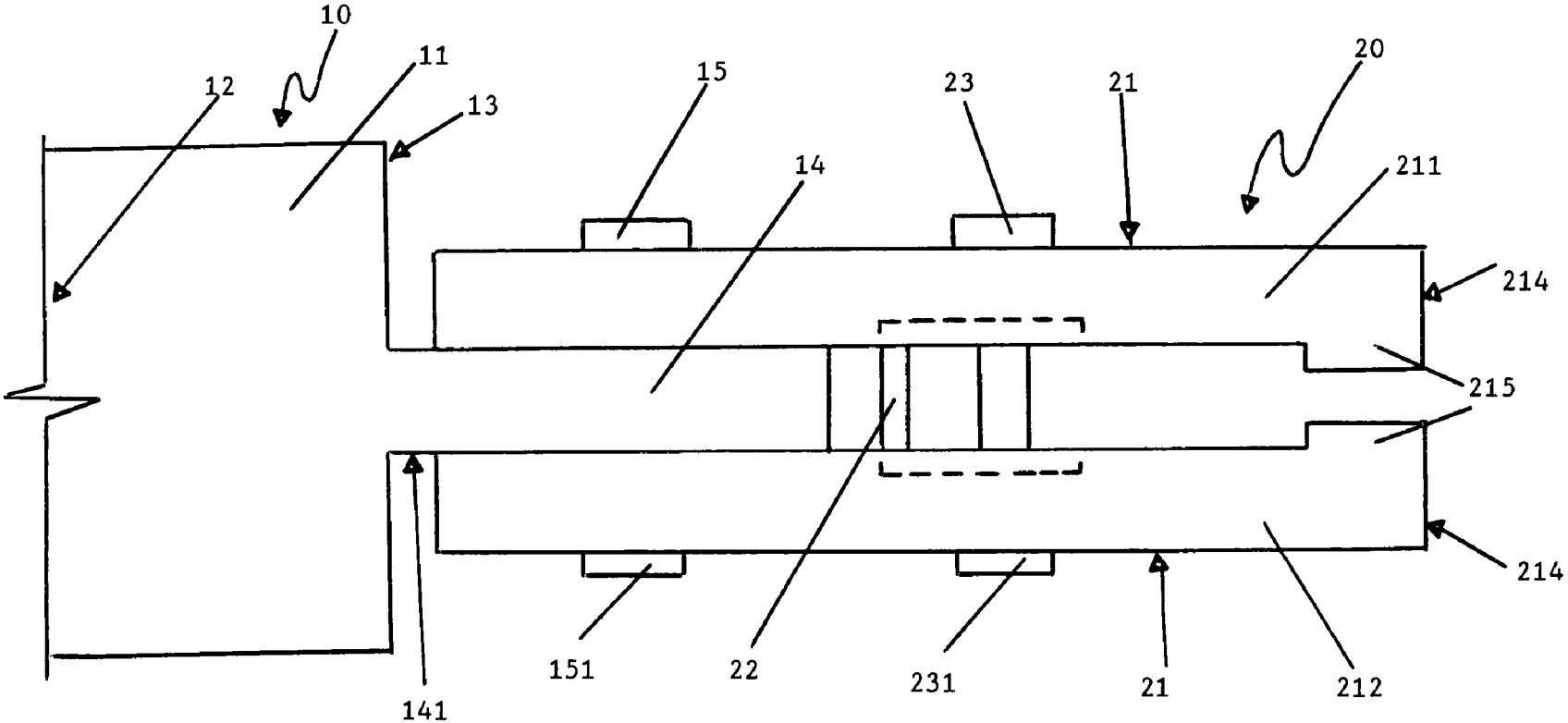
FIG. 3 is a top-down plan view of a variant of the simplest embodiment.
Figure 4:
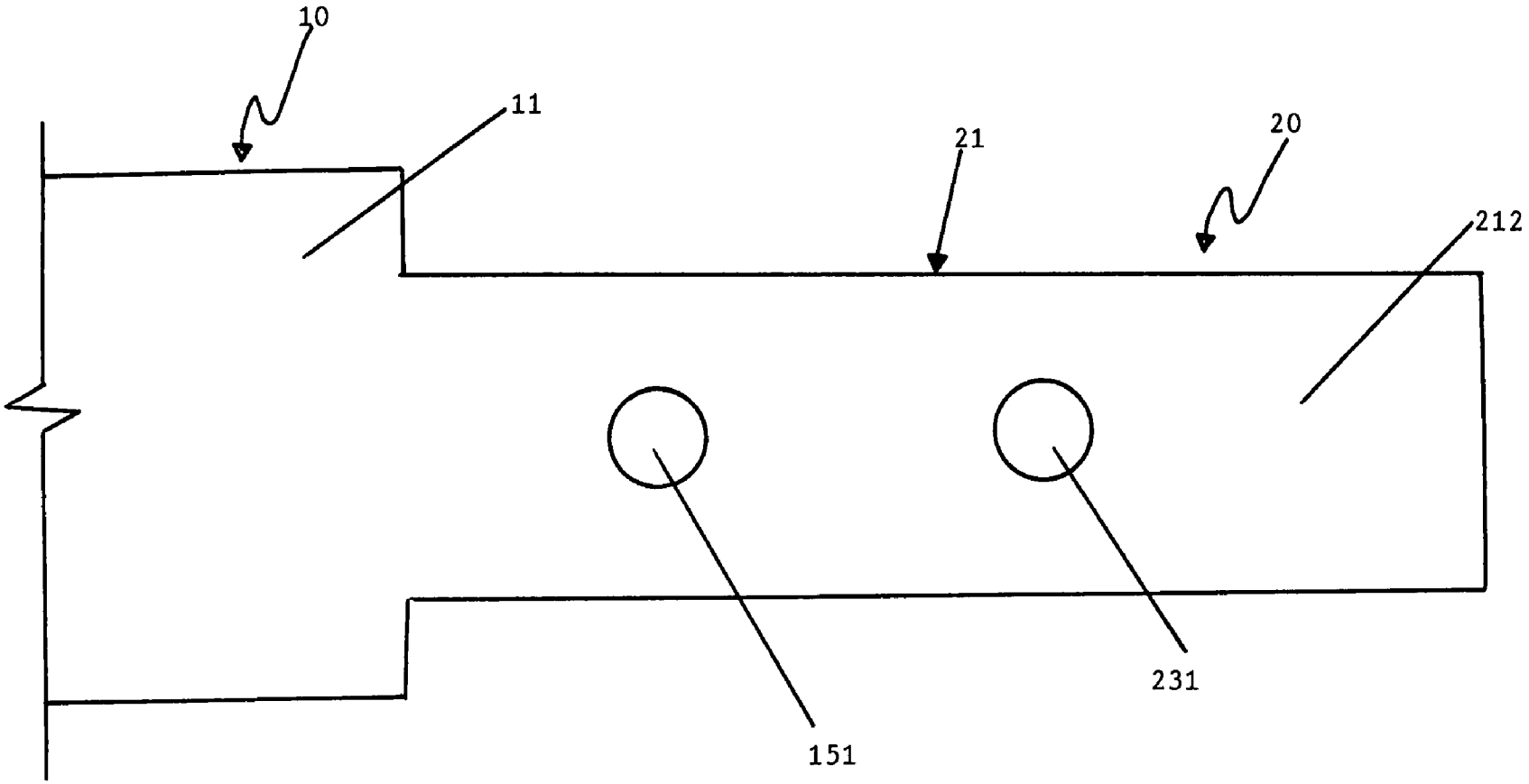
FIG. 4 is a side view of a variant of the simplest embodiment.
Figure 5:
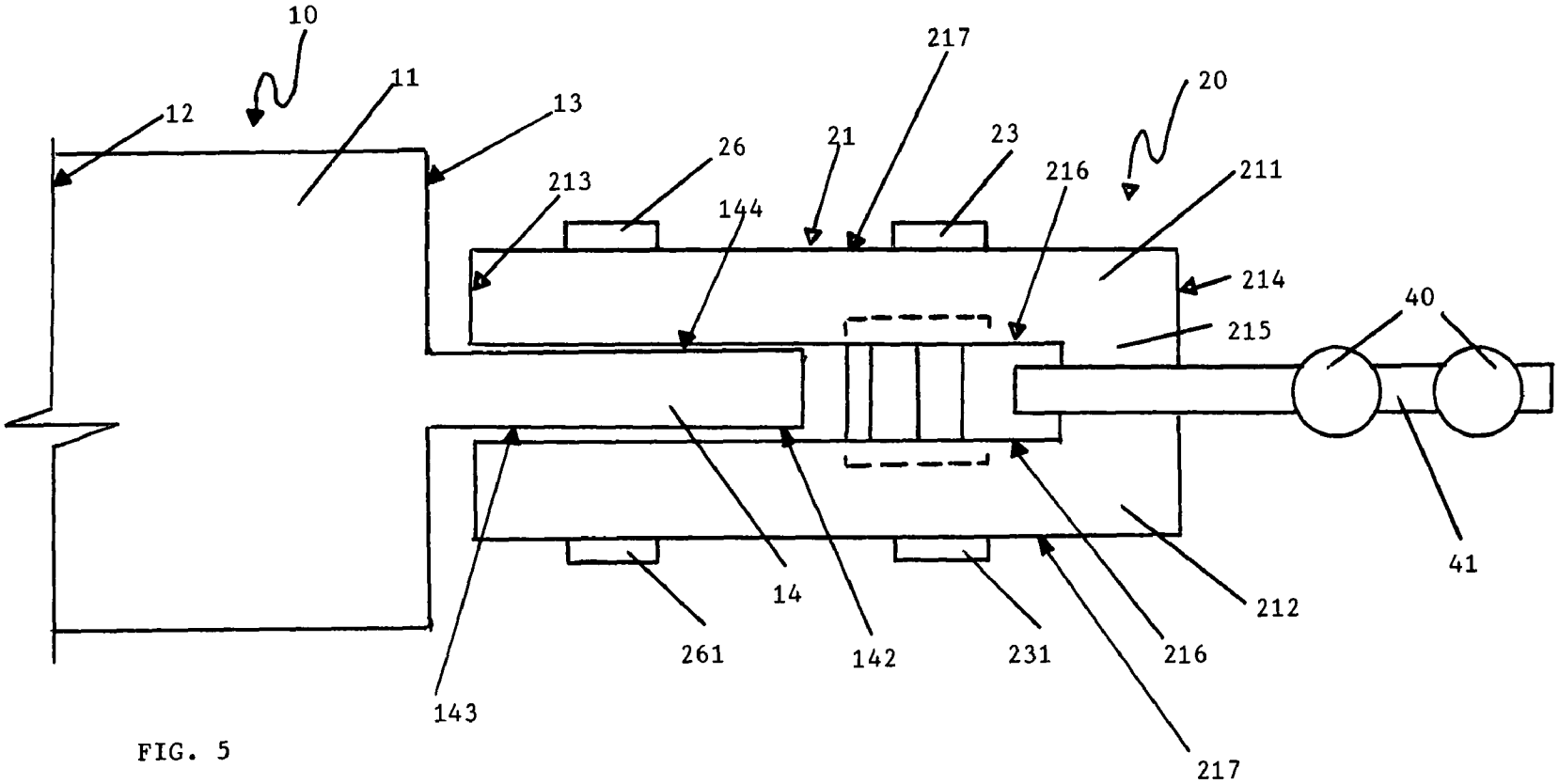
FIG. 5 is a top-down plan view of an alternative (vertical rotation) embodiment.

FIGS. 3 and 4 show a variant of the simplest embodiment where the nail-holding assembly 20 consists of two nail-holding plates 21 (211,212) that are rigidly and permanently attached on opposite sides of a generally rectangular solid stationary mounting bar 14 having a generally rectangular cross-section and that extends perpendicularly from the center of the distal end 13 of the handle 11. The handle 11 and stationary mounting bar 14 are typically cast or extruded as a single piece to maximize the strength and durability of the device. Casting these components separately and then firmly and permanently inserting the stationary mounting bar 14 into the distal end 13 of the handle 11 is an option that affords the user the opportunity to use different materials to construct the handle 11 and the stationary mounting bar 14.

The handle 11 and nail-holding plates 21 are composed of a lightweight, non-deformable, and durable material that can be easily cast or extruded. Accordingly, materials such as a hard rubber or plastic compound, nylon, aluminum, composite material, and the like would be suitable choices.

While the length of the handle 11 can very from user to user, an overall length in the range of 10 inches to 16 inches is considered optimal to extend the reach of the user as contemplated by this invention. A handle as short as four inches might also be desirable to simply position a multiplicity of nails 40 just beyond the reach of the user while affording the user more control over the positioning of the nails 40. This variant of the simplest embodiment can be used with either the straight, cylindrical handle 11 or the curved handle 11 used by the simplest embodiment.

The nail-holding plates 21 are identical to the nail-holding plates 21 found with the simplest embodiment. However, the nail-holding plates 21 in this variant of the simplest embodiment are secured to the stationary mounting bar 14 by means of a threaded attaching pin 15 that extends all the way through both nail-holding plates 21 (211,212) and the stationary mounting bar 14 near the proximal end 141 of the stationary mounting bar 14. The threaded attaching pin 15 screws into an attaching pin cap 151 so as to rigidly, permanently, and securely fasten the nail-holding plates 21 to the stationary mounting bar 14. While the attaching pin 15 and the attaching pin cap 151 are typically composed of stainless steel, numerous alternative materials including, without limitation, chrome-plated metals, plastics, hardened rubber, and the like are also suitable alternatives. This version of the simplest embodiment also contemplates rigidly, permanently, and securely fastening the nail-holding plates 21 (211,212) to the stationary mounting bar 14 by alternative means including, without limitation, industrial adhesives, thermal fusion, and the like.

The user would then hold the device at arm's length. The overall length of the handle 11 extends the reach of the user accordingly while the nail-holding assembly 20 safely and securely grips the nails 40 so as to preclude the likelihood of injury to the user's thumb and fingers from the hammer. The user can now safely position and hammer a single nail 40 or a multiplicity of nails 40 held in a nail strip 41 well beyond arms length.

Description—Alternative Embodiment (Vertical Rotation)

Referring to FIGS. 5-10, an alternative embodiment of the present invention provides the user with additional advantages over devices disclosed by the prior art by permitting operation in an increased number of hard-to-reach and otherwise inaccessible places. This alternative embodiment provides this flexibility by allowing the user to rotate the nail-holding assembly 20 vertically through at least a 180 degree arc. Not only is the user able to place a multiplicity of nails 40 in position for nailing well beyond arm's length, he or she can also rotate the nail-holding assembly 20 to position a multiplicity of nails 40 at a number of different vertical angles from the handle 11. Moving the nail-holding assembly 20 in this manner allows the user to hammer a multiplicity of nails 40 beyond arm's length and at a vertical angle from the handle 11 without having to constantly reload the nail-holding assembly 20 or move the handle 11 to reposition the nail 40 or the nail strip 41 at the desired vertical angle from the handle 11.

Figure 7:
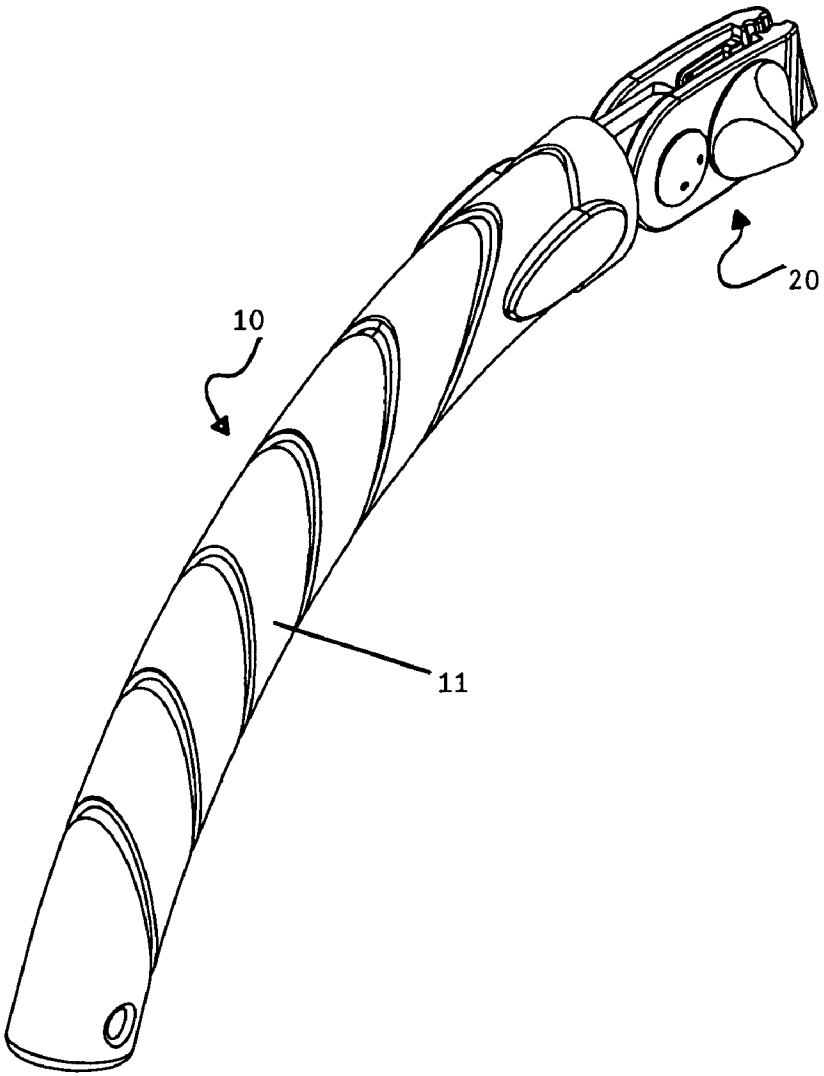
FIG. 7 is a perspective view of an alternative embodiment (vertical rotation) with an ergonomic handle.

The simplest configuration of this alternative (vertical rotation) embodiment has a generally solid cylindrical handle 11. FIGS. 7-8 show various views of this alternative (vertical rotation) embodiment with a curved, ergonomically efficient handle 11. FIG. 10 shows the range of rotational movement of the nail-holding assembly 20 in a vertical plane.

Referring again to FIGS. 5-9, this alternative (vertical rotation) embodiment of the present invention also has a handle assembly 10 and a closeable nail-holding assembly 20. The handle assembly 10 consists of an ergonomically curved solid handle 11 having a generally oval-shaped cross section or, in a simpler variant, a solid cylindrical handle 11. The handle 11 has a proximal end 12, a distal end 13, and a solid stationary mounting bar 14 having a rectangular cross section and protruding from the center of the distal end 13 of the handle 11. The handle 11 and stationary mounting bar 14 are typically uniformly cast, molded, or extruded as a single piece to maximize the strength and durability. Casting these components separately and/or from different materials and then firmly and permanently inserting the stationary mounting bar 14 into the center of the distal end 13 of the handle 11 is an option that affords the user flexibility on materials and mode of assembly.

The handle 11 and stationary mounting bar 14 are composed of a lightweight, non-deformable, and durable material that can be easily cast, molded, or extruded. Accordingly, materials such as a hard rubber or plastic compound, nylon, aluminum, composite material, and the like would be suitable choices.

While the length of the handle 11 can vary from user to user, an overall length in the range of 10 inches to 16 inches is considered optimal. A handle 11 as short as four inches might also be desirable to simply position a single nail 40 or a multiplicity of nails 40 just beyond the reach of the user while affording the user more control over the positioning of the nails 40.

As mentioned previously, the simplest variant of this alternative (vertical rotation) embodiment contemplates a straight, generally cylindrical handle 11. Alternative designs for this alternative embodiment (vertical rotation) contemplate a curved handle 11 with an oval-shaped cross section. The embodiments pictured in FIGS. 7-9, and 14-19 give various views of this curved handle 11. The curved handle 11 provides the user with a handle 11 that is comfortable to grasp and hold for long periods of time thereby making it an ergonomically efficient building construction or carpentry tool.

Referring to FIGS. 5, 6, 8, and 9, the stationary mounting bar 14 is solid and generally rectangular in shape with a rectangular cross section and a generally tapered (FIG. 6) or semi-circular, rounded (FIGS. 8, 9) distal end 142. A positioning hole 16 is located in the center of the tapered or rounded distal end 142 to permit attaching the nail-holding assembly 20 to the handle assembly 10 with a pivot pin 26.

In one configuration of this alternative (vertical rotation) embodiment, the nail-holding assembly 20 is rotatably attached to the stationary mounting bar 14 by a threaded pivot pin 26. The pivot pin 26 extends all the way through the nail-holding assembly 20 and through the positioning hole 16 located in the center of the generally tapered or rounded, semi-circular distal end 142 of the stationary mounting bar 14. The pivot pin 26 screws into a pivot pin cap 261 so as to securely fasten the nail-holding assembly 20 to the mounting bar 14 while still permitting the user to slidably rotate the nail-holding assembly 20 vertically around the stationary mounting bar 14.

In such a configuration, the threaded pivot pin 26 is loosened so that the user can slidably rotate the nail-holding assembly 20 to the desired angle. The user would then retighten the pivot pin 26 to prevent unwanted movement of the nail-holding assembly 20 while the user is hammering the nails 40 held therein. While the pivot pin 26 and the pivot pin cap 261 are typically composed of stainless steel, numerous alternative materials including, without limitation, chrome-plated metals, plastics, hardened rubber, and the like are also suitable alternatives.

There is another configuration of this alternative (vertical rotation) embodiment whereby the steps of loosening and then re-tightening the pivot pin 26 are not required. FIGS. 7, 8, and 9 show this configuration in greater detail. The stationary mounting bar 14 is solid and rectangular in shape with a rectangular cross section and a generally tapered or semi-circular, rounded distal end 142. A positioning hole 16 is drilled through the center of the distal end 142 to permit attaching the nail-holding assembly 20 to the handle assembly 10. A number of evenly-spaced grooves 17 extend radially outward from the periphery of the positioning hole 16 on both the right side 143 of the stationary mounting bar 14 and also on the left side 144 of the stationary mounting bar 14. The number and spacing of grooves 17 may vary from model to model but the number and spacing should be sufficient to permit incremental vertical movement of the nail-holding assembly 20 through an arc of at least 180 degrees.

The nail-holding assembly 20 for this particular embodiment also consists of two nail holding plates 21: a left nail-holding plate 211 and a right nail-holding plate 212 held apart by a U-shaped separator 22 with a tightening hole 222 drilled through each separator leg 221. The inherent elasticity in the material constituting the separator 22 tends to push the nail-holding plates 21 (211,212) apart. As such, materials such as, without limitation, stainless steel, a hardened rubber, or a hard, resilient plastic would be suitable for materials making up the separator 22.

The nail-holding plates 21 (211,212) are typically composed of a lightweight, durable, and non-deformable material such as a hard rubber or plastic compound, nylon, aluminum, composite material, and the like. The nail-holding plates 21 (211,212) are rectangular in shape with a generally tapered or semi-circular rounded proximal end 213 and an angled or vertical distal end 214. The tapered or rounded proximal end 213 permits vertical rotation of the nail-holding assembly 20 without hitting the distal end 13 of the handle 11.

Each nail-holding plate 21 (211,212) has an inner surface 216 and an outer surface 217. Each nail-holding plate 21 (211,212) also has a positioning hole 24 located in the center of the tapered or rounded proximal end 213. As mentioned previously, the threaded pivot pin 26 is inserted through these positioning holes 24 as well as through the positioning hole 16 in the stationary mounting bar 14. The threaded pivot pin 26 is then screwed into the pivot pin cap 261 to permit attaching the nail-holding assembly 20 to the handle assembly 10.

This alternative (vertical rotation) embodiment contemplates the optional use of a wavy washer 27 inserted between the pivot pin 26 and the outer surface 217 of the left nail-holding plate 211 and another wavy washer 27 inserted between the pivot pin cap 261 and the outer surface 217 of the right nail-holding plate 212. The wavy washers 27 are positioned concavely on the outer surface 217 of each nail-holding plate 21 (211,212) to facilitate removal of the pivot pin 26 and the pivot pin cap 261 when necessary.

Each nail-holding plate 21 (211,212) also has a tightening hole 28 near the distal end 214. A tightening pin 23 is inserted through the tightening holes 28 on the nail-holding plates 21 (211,212) as well as through the tightening holes 222 located in the separator legs 221. The tightening pin 23 is then screwed into a tightening pin cap 231 to permit the user to easily and securely tighten the nail-holding plates 21 (211, 212) around a nail 40 or a nail strip 41. While the tightening pin 23 and the tightening pin cap 231 are typically composed of stainless steel, numerous alternative materials including, without limitation, chrome-plated metals, plastic, hardened rubber, and the like are also suitable alternatives.

On the inner surface 216 of each nail-holding plate 21 (211,212), a series of raised positioning notches 25 extend radially outward from the periphery of the positioning hole 24. The positioning notches 25 are dimensioned to fit snugly into the grooves 17 located on the right side 143 and the left side 144 of the stationary mounting bar 14. The number of positioning notches 25 may vary. A single positioning notch 25 is sufficient to slip into a single groove 17 and thereby hold the nail-holding assembly 20 at the desired vertical angle while the user hammers the nails 40 into the receiving surface. Two positioning notches 25 directly opposite one another provide an additional measure of security against inadvertent slippage of the nail-holding assembly 20. Similarly, four positioning notches 25 positioned 90 degrees apart as shown in FIGS. 8 and 9 and as found in the preferred embodiment of the present invention, provide even more security against inadvertent slippage.

Figure 6:
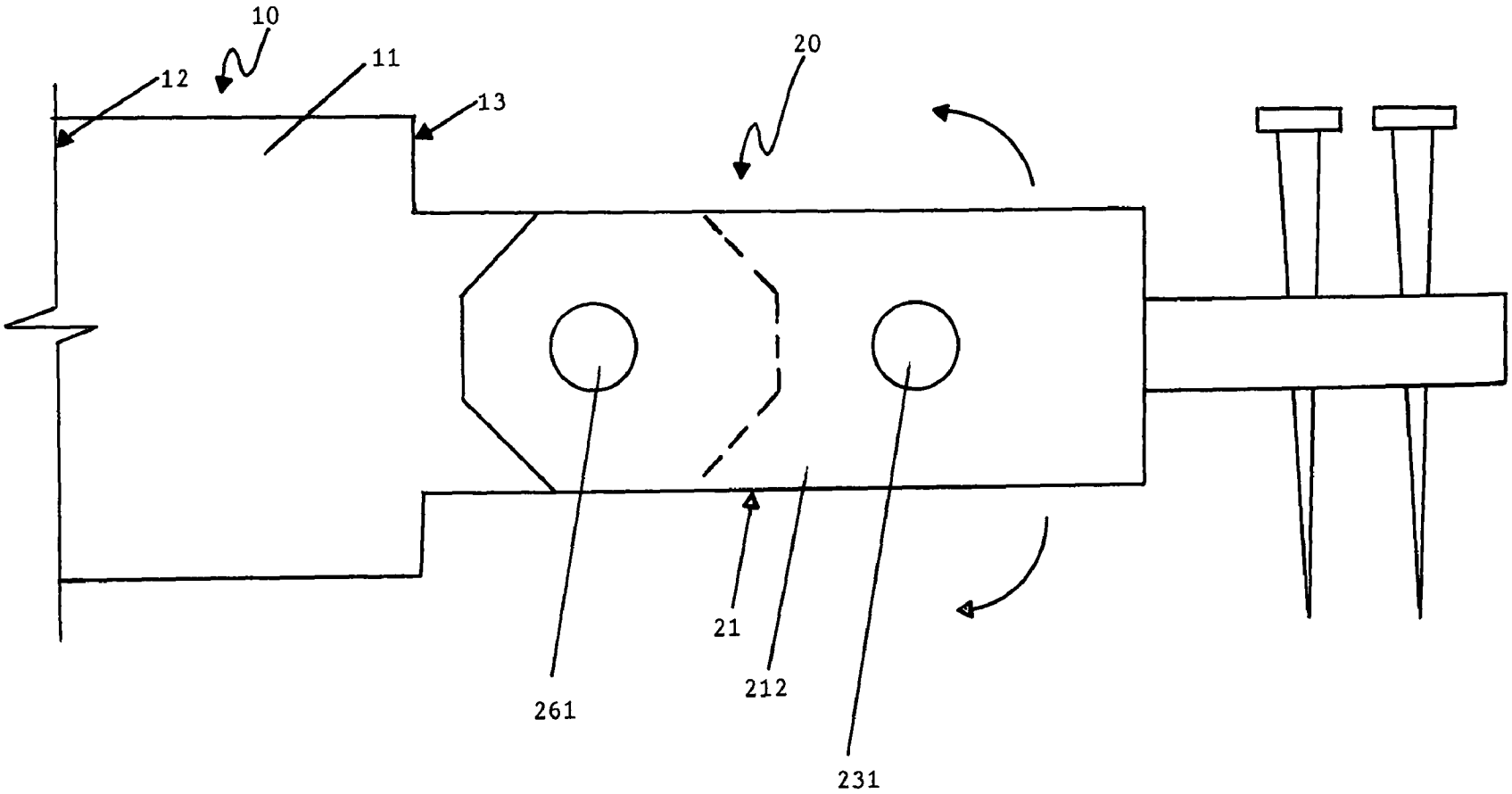
FIG. 6 is a side view of an alternative (vertical rotation) embodiment.

Typically, a carpenter will position nails 40 at a 90 degree angle (perpendicular) to the surface into which they will be hammered. However, nails 40 mounted or otherwise disposed in a breakable nail strip 41 are often mounted at an angle. To accommodate such a configuration, the distal end 214 of the nail-holding plate 21 can be angled as shown in FIGS. 8-10 so as to vertically align nails 40 that are angularly disposed in a breakable nail strip 41. This alternative (vertical rotation)

embodiment can also be constructed to accommodate nails 40 that are vertically disposed in a nail strip 41 by aligning the distal end 214 vertically as is shown in FIG. 6.

As mentioned previously, the gripping function of the nail-holding plates 21 (211,212) is controlled by a threaded tightening pin 23. The tightening pin 23 extends through the tightening holes 28 and 222 located, respectively, in the nail-holding plates 21 (211,212) and the separator legs 221. The tightening pin 23 screws into a tightening pin cap 231 so as to draw the nail-holding plates 21 (211, 212) together. A gripping surface 215 on the inside of each nail-holding plate's 21 (211,212) distal end 214 securely holds the nail 40 or the nail strip 41 so that the nail 40 or the nail strip 41 will not fall out of the nail-holding plates 21 (211,212). Referring again to FIGS. 8 and 9, the gripping surface 215 is typically a groove or other such indentation that has been machined or cut into the inner surface 216 of each nail-holding plate's 21 (211, 212) distal end 214.

Accordingly, the user, as with the simplest embodiment, positions and hammers a single nail 40 or a multiplicity of nails 40 held in a nail strip 41 beyond arm's length. Further, the user can now rotate the nail-holding assembly 20 vertically through a 180 degree arc to reach angular surfaces at the same extended distance.

Description—Alternative Embodiment (Horizontal Rotation)

Referring to FIGS. 11, 11*a*, 11*b*, 11*c*, and 12, another alternative embodiment of the present invention provides the user with additional advantages over devices disclosed by the prior art by permitting operation in an increased number of hard-to-reach and otherwise inaccessible places. This alternative (horizontal rotation) embodiment provides this flexibility by allowing the user to rotate the nail-holding assembly 20 horizontally through at least a 180 degree arc. Not only is the user able to place a multiplicity of nails 40 in position for nailing well beyond arm's length, he or she can also rotate the nail holding assembly 20 to position a multiplicity of nails 40 at a number of horizontal angles from the handle 11. Moving the nail-holding assembly 20 in this manner allows the user to hammer a multiplicity of nails 40 beyond arm's length and at a horizontal angle from the handle 11 without having to constantly reload the nail holding assembly 20 or move the handle 11 to reposition the nail 40 at the desired horizontal angle from the handle 11.

Similar to the other embodiments, this alternative (horizontal rotation) embodiment is comprised of a handle assembly 10 and a closeable nail holding assembly 20 that is designed to hold a single nail 40 or a breakable nail strip 41 containing a multiplicity of nails 40. The handle assembly 10 consists of a uniformly cast and generally cylindrical solid handle 11 having a proximal end 12 and a distal end 13. Another version of the alternative (horizontal rotation) embodiment has a curved handle 11 with an oval-shaped cross section. FIGS. 7 and 15-19 give various views and perspectives of this curved handle 11. The curved handle 11 provides the user with a handle 11 that is comfortable to grasp and hold for long periods of time thereby making it an ergonomically efficient building construction or carpentry tool.

While the length of the handle 11 can vary from user to user, an overall length in the range of 10 inches to 16 inches is considered optimal. A handle 11 as short as four inches might also be desirable to simply position a single nail 40 or a multiplicity of nails 40 just beyond the reach of the user while affording the user more control over the positioning of the nails 40.

A generally rectangular solid stationary mounting bar 14 having a rectangular cross-section extends perpendicularly from the center of the distal end 13 of the handle 11. The handle 11 and stationary mounting bar 14 are typically cast or extruded as a single piece to maximize the strength and durability of the device. Casting these components separately and then firmly and permanently inserting the stationary mounting bar 14 into the distal end 13 of the handle 11 is an option that affords the user flexibility on materials and mode of assembly.

The handle 11 and stationary mounting bar 14 are composed of a lightweight, non-deformable, and durable material that can be easily cast, molded, or extruded. Accordingly, materials such as a hard rubber or plastic compound, nylon, aluminum, composite material, and the like would be suitable choices.

The nail-holding assembly 20 for this alternative (horizontal rotation) embodiment consists of a solid, U-shaped block 180 that has been molded, cast, extruded or machined with a box-shaped hollow slot 201 disposed in the center of the generally tapered or rounded, semi-circular proximal end 213 of the U-shaped block 180. The left and right legs of the U-shaped block 180 make up, respectively, the left nail-holding plate 211 and the right nail-holding plate 212 for this alternative (horizontal rotation) embodiment. The slot 201 is dimensioned to fit snugly over the stationary mounting bar 14 which has been tapered or rounded at its distal end 142 to permit the nail-holding assembly 20 to easily rotate around the stationary mounting bar 14 without hitting the distal end 13 of the handle 11 or the distal end 142 of the stationary mounting bar 14. The nail-holding assembly 20 is uniformly cast and typically composed of a lightweight, durable, and non-deformable material such as a hard rubber or plastic compound, nylon, aluminum, composite material, and the like.

Referring again to FIGS. 11, 11*b*, 11*c*, and 12, the nail-holding plates 21 (211,212) are generally rectangular in shape with an angled or vertical distal end 214 opposite the generally tapered or rounded semi-circular proximal end 213. The left nail-holding plate 211 and the right nail-holding plate 212 are separated by a U-shaped elastic separator 22. The inherent elasticity in the material which constitutes the separator 22 tends to move the nail-holding plates 21 (211,212) apart. As such, materials such as, without limitation, stainless steel, a hardened rubber, or a hard, resilient plastic would be suitable for materials making up the separator 22.

Referring to FIGS. 11 and 12, one configuration of this alternative (horizontal rotation) embodiment has the nail-holding assembly 20 rotatably attached to the stationary mounting bar 14 by a threaded pivot pin 26. The pivot pin 26 extends all the way through the nail-holding assembly 20 and the stationary mounting bar 14 near the distal end 142 of the stationary mounting bar 14. The pivot pin 26 screws into a pivot pin cap 261 so as to securely fasten the nail-holding assembly 20 to the mounting bar 14 while still permitting the user to rotate the nail-holding assembly 20 horizontally.

In such a configuration, the threaded pivot pin 26 is loosened so that the user can slidably rotate the nail holding assembly 20 to the desired horizontal angle from the handle 11. The user would then retighten the pivot pin 26 to prevent unwanted movement of the nail-holding assembly 20 while the user is hammering the nails 40 held therein. While the pivot pin 26 and the pivot pin cap 261 are typically composed of stainless steel, numerous alternative materials including, without limitation, chrome-plated metals, plastics, hardened rubber, and the like are also suitable alternatives.

This alternative (horizontal rotation) embodiment contemplates the optional use of a wavy washers 27 inserted between the pivot pin 26 and the block 180 and another wavy washer 27 inserted between the pivot pin cap 261 and the block 180. The wavy washers 27 are positioned concavely on the block 180 to facilitate removal of the pivot pin 26 and the pivot pin cap 261 when necessary.

Referring again to FIG. 11*a*, there is a configuration whereby loosening and then re-tightening the pivot pin 26 is not required. The stationary mounting bar 14 is, again, solid and rectangular in shape with a rectangular cross section and a generally tapered or semi-circular, rounded distal end 142. A positioning hole 16 is located in the center of the distal end 142 of the stationary mounting bar 14 to permit attaching the nail-holding assembly 20 to the stationary mounting bar 14 and, as such, the handle assembly 10. A number of evenly-spaced grooves 17 extend radially outward from the periphery of the positioning hole 16 on both the top surface 145 of the stationary mounting bar 14 and the bottom surface 146 of the stationary mounting bar 14. The number and spacing of grooves 17 may vary from model to model but the number and spacing should be sufficient to permit the user to impart incremental movement of the nail-holding assembly 20 through an arc of at least 180 degrees in a horizontal plane.

Similar to the vertical rotation embodiment (FIGS. 8 and 9), this horizontal rotation embodiment has, on the horizontal inner surfaces 216 of the U-shaped block 180 (FIGS. 11*a* and 11*b*), a series of raised positioning notches 25 that extend radially outward from the periphery of a positioning hole 24 located in the center of the nail-holding assembly's 20 generally tapered or rounded, semi-circular proximal end 213. The positioning notches 25 are dimensioned to fit snugly into the grooves 17 located on the top surface 145 of the stationary mounting bar 14 and the bottom surface 146 of the stationary mounting bar 14. The number of positioning notches 25 may vary. A single positioning notch 25 is sufficient to slip into a single groove 17 and thereby hold the nail-holding assembly 20 at the desired horizontal angle while the user hammers the nails 40 into the receiving surface. Two positioning notches 25 directly opposite one another provide an additional measure of security against inadvertent horizontal slippage of the nail-holding assembly 20. Similarly, four positioning notches 25, positioned 90 degrees apart as shown in FIGS. 8, 9, and 11*a* and as found in the preferred embodiment of the present invention, provide even more security against inadvertent horizontal slippage.

The U-shaped block 180 portion of the nail-holding assembly 20 has two horizontal inner surfaces 216 created by the slot 201 located in the center of the proximal end 213. Each of the legs that form the two nail-holding plates 21 (211,212) has a vertical inner surface 216 and an outer surface 217. The nail-holding assembly 20 has a positioning hole 24 located in the center of the tapered or rounded proximal end 213 to permit attaching the nail-holding assembly 20 to the stationary mounting bar 14 and, as such, the handle assembly 10. Each nail-holding plate 21 (211,212) has a tightening hole 28 near the distal end 214 through which a tightening pin 23 is inserted to permit the user to securely tighten the nail-holding plates 21 (211,212) around a nail 40 or a nail strip 41.

The threaded tightening pin 23 extends all the way through the left nail-holding plate 211 near its distal end 214, through the tightening holes 222 located in both separator legs 221, through the right nail-holding plate 212 near its distal end 214, and screws into a tightening pin cap 231 so as to draw the nail-holding plates 21 (211, 212) together. While the tightening pin 23 and the tightening pin cap 231 are typically composed of stainless steel, numerous alternative materials including, without limitation, chrome-plated metals, plastics, hardened rubber, and the like are also suitable alternatives.

A gripping surface 215 on the inner surface 216 of each nail-holding plate's 21 (211,212) distal end 214 securely holds the nail 40 or the nail strip 41 so that the nail 40 or the nail strip 41 will not fall out of the nail-holding plates 21 (211,212). Referring again to FIGS. 8 and 9, the gripping surface 215 is typically a groove or other such indentation that has been machined or cut into the inner surface 216 of each nail-holding plate's 21 (211,212) distal end 214.

Typically, a carpenter will position nails 40 at a 90 degree angle (perpendicular) to the surface into which they will be hammered. However, nails 40 mounted or otherwise disposed in a breakable nail strip 41 are often mounted at an angle. To accommodate such a configuration, the distal end 214 of the nail-holding plate 21 can be angled as shown in FIGS. 8-10 so as to vertically align nails 40 that are angularly disposed in a breakable nail strip 41. This alternative (vertical rotation) embodiment can also be constructed to accommodate nails 40 that are vertically disposed in a nail strip 41 by aligning the distal end 214 vertically as is shown in FIGS. 11*c* and 12.

Accordingly, the user, as with the simplest embodiment, positions and hammers a single nail 40 or a multiplicity of nails 40 held in a nail strip 41 beyond arm's length. Further, the user can now rotate the nail holding assembly 20 horizontally through a 180 degree arc to reach angular surfaces at the same extended distance.

Description—Preferred Embodiment

FIGS. 13, 13*a*, 13*b*, 13*c*, 13*d*, 13*e*, and 14 show the preferred embodiment of the present invention. The preferred embodiment provides the user with even more advantages over devices disclosed by the prior art by permitting operation in an even greater number of hard-to-reach and otherwise inaccessible places. The preferred embodiment provides this flexibility by allowing the user to rotate the nail-holding assembly 20 in both a horizontal and a vertical plane. Not only is the user able to place a multiplicity of nails 40 in position for nailing beyond arm's length, he or she can also rotate the nail-holding assembly 20 to position a nail 40 or a multiplicity of nails 40 at a horizontal and/or a vertical angle from the handle 11. Moving the nail-holding assembly 20 in this manner allows the user to hammer a multiplicity of nails 40 beyond arm's length and place them multi-dimensionally from the handle 11 without having to reload the nail-holding assembly 20 or move the handle 11 to reposition it. FIG. 10 shows the range of rotational movement of the nail-holding assembly 20 in a vertical plane while FIG. 13*e* shows the range of rotational movement of the nail-holding assembly 20 in a horizontal plane.

Similar to the other embodiments, the preferred embodiment is comprised of a handle assembly 10 and a closeable nail-holding assembly 20 that is designed to hold a single nail 40 or a breakable nail strip 41 containing a multiplicity of nails 40. The handle assembly 10 consists of a uniformly cast and generally cylindrical solid handle 11 having a proximal end 12 and a distal end 13. A generally rectangular and solid stationary mounting bar 14 having a generally rectangular cross-section extends perpendicularly from the center of the distal end 13 of the handle 11. The handle 11 and stationary mounting bar 14 are typically cast or extruded as a single piece to maximize the strength and durability of the device. Casting these components separately and then firmly and permanently inserting the stationary mounting bar 14 into the center of the distal end 13 of the handle 11 is an option that affords the user flexibility on materials and mode of assembly.

The handle 11 and stationary mounting bar 14 are composed of a lightweight, non-deformable, and durable material that can be easily cast, molded, or extruded. Accordingly, materials such as a hard rubber or plastic compound, nylon, aluminum, composite material, and the like would be suitable choices.

Another version of the preferred embodiment has a curved handle 11 with an oval-shaped cross section. FIGS. 7 and 15-19 give various views and perspectives of this curved handle 11. The curved handle 11 provides the user with a handle 11 that is comfortable to grasp and hold for long periods of time thereby making it an ergonomically efficient building construction or carpentry tool.

While the length of the handle 11 can vary from user to user, an overall length in the range of 10 inches to 16 inches is considered optimal. A handle 11 as short as four inches might also be desirable to simply position a single nail 40 or a multiplicity of nails 40 just beyond the reach of the user while affording the user more control over the positioning of the nails 40.

Referring again to FIGS. 13, 13*a*, 13*b*, 13*c*, and 13*d*, a movable mounting bar 18 is rotatably attached to the stationary mounting bar 14 in the same manner that the nail-holding assembly 20 is rotatably attached to the stationary mounting bar 14 in the alternative (horizontal rotation) embodiment. The stationary mounting bar 14 is solid and rectangular in shape with a rectangular cross section and a generally tapered or rounded, semi-circular rounded distal end 142. A positioning hole 16 is located in the center of the stationary mounting bar's 14 distal end 142 to permit attaching the movable mounting bar 18 to the stationary mounting bar 14.

The movable mounting bar 18 is simply a U-shaped rectangular block 180 with two solid rectangular legs 181,182 of rectangular cross-section forming a box-shaped slot 183 in the center of the generally tapered or rounded, semi-circular proximal end 184 of the movable mounting bar 18. The slot 183 is dimensioned so that the legs 181,182 fit snugly over the stationary mounting bar 14 which has been tapered or rounded at its distal end 142 to permit the movable mounting bar 18 to rotate horizontally around the stationary mounting bar 14 without hitting the distal end of the handle 13 or the distal end 142 of the stationary mounting bar 14. The movable mounting bar 18 is typically composed of the same material as the stationary mounting bar 14. However, any lightweight, durable, and non-deformable material such as a hard rubber or plastic compound, nylon, aluminum, composite material, and the like will be adequate.

The upper leg 181 and the lower leg 182 have a positioning hole 186 located in the center of the rounded proximal end 184 to permit attaching the movable mounting bar 18 to the stationary mounting bar 14. This positioning hole 186 would be aligned with the positioning hole 16 in the stationary mounting bar 14.

In the preferred embodiment, the movable mounting bar 18 is rotatably attached to the stationary mounting bar 14 by a threaded pivot pin 26. The pivot pin 26 extends all the way through the positioning holes 186 in the movable mounting bar 18 and the positioning hole 16 in the stationary mounting bar 14. The pivot pin 26 screws into an pivot pin cap 261 so as to securely fasten the movable mounting bar 18 to the mounting bar 14 but permit the user to rotate the movable mounting bar 18 horizontally. In this configuration, the threaded pivot pin 26 is loosened so that the user can rotate the movable mounting bar 18 to the desired angle. The user would then retighten the pivot pin 26 to prevent unwanted movement of the movable mounting bar 18 while the user is hammering the nails 40 held in the nail-holding assembly 20. While the pivot pin 26 and the pivot pin cap 261 are typically composed of stainless steel, numerous alternative materials including, without limitation, chrome-plated metals, plastics, hardened rubber, and the like are also suitable alternatives.

The preferred embodiment contemplates the optional use of a wavy washers 27 inserted between the pivot pin 26 and the block 180 and another wavy washer 27 inserted between the pivot pin cap 261 and the block 180. The wavy washers 27 are positioned concavely on the block 180 to facilitate removal of the pivot pin 26 and the pivot pin cap 261 when necessary.

The preferred embodiment also has a configuration whereby loosening and then re-tightening the pivot pin 26 is not required. Referring to FIGS. 13 and 13*d*, the movable mounting bar 18 would be attached to the stationary mounting bar 14 in the same manner that the nail-holding assembly 20 is attached to the stationary mounting bar 14 in the alternative (horizontal rotation) embodiment.

The stationary mounting bar 14 is solid and rectangular in shape with a rectangular cross section and a generally tapered or rounded, semi-circular distal end 142. A positioning hole 16 is located in the center of the rounded distal end 142 to permit attaching the movable mounting bar 18 to the stationary mounting bar 14 and, as such, the handle assembly 10. A number of evenly-spaced grooves 17 extend radially outward from the periphery of the positioning hole 16 on both the top surface 145 of the stationary mounting bar 14 and also on the bottom surface 146 of the stationary mounting bar 14. The number and spacing of grooves 17 may vary from model to model but the number and spacing should be sufficient to permit incremental movement of the movable mounting bar 18 through an arc of at least 180 degrees in a horizontal plane.

Similar to the horizontal rotation embodiment, the preferred embodiment (FIG. 13*d*) has, on the horizontal leg inner surfaces 187 of the movable mounting bar 18, a series of raised positioning notches 188 that extend radially outward from the periphery of a positioning hole 186 located in the center of the movable mounting bar's 18 generally tapered or rounded, semi-circular proximal end 184. The positioning notches 188 are dimensioned to fit snugly into the grooves 17 located on the top surface 145 of the stationary mounting bar 14 and the bottom surface 146 of the stationary mounting bar 14. The number of positioning notches 188 may vary. A single positioning notch 188 is sufficient to slip into a single groove 17 and thereby hold the movable mounting bar 18 and, as such, the nail-holding assembly 20 at the desired horizontal angle while the user hammers the nails 40 into the receiving surface. Two positioning notches 188 directly opposite one another provide an additional measure of security against inadvertent horizontal slippage of the nail-holding assembly 20. Similarly, four positioning notches 188 positioned 90 degrees apart as shown in FIGS. 8, 9, 11*a* and 13*d* provide even more security against inadvertent horizontal slippage.

Referring again to FIGS. 13, 13*a*, 13*b*, and 13*c*, attached to and protruding perpendicularly from the distal end 185 of the movable mounting bar 18 is a vertically aligned second stationary mounting bar 19. This second stationary mounting bar 19 is solid, rectangular in shape with a rectangular cross section and a generally tapered (FIG. 13*b*) or rounded, semi-circular (FIG. 13*a*) distal end 191. The movable mounting bar 18 with its vertically aligned second stationary mounting bar 19 are typically cast or extruded as a single piece to maximize the strength and durability of the device. Casting these components separately and then firmly and permanently inserting the second stationary mounting bar 19 into the distal end 185 of the movable mounting bar 18 is also an option. Such a configuration affords the user flexibility on materials and mode of assembly. A positioning hole 192 is located in the center of the rounded distal end 191 of the second stationary mounting bar 19 to accommodate attaching the nail-holding assembly 20 to the second stationary mounting bar 19 with a pivot pin 26.

In one configuration of the preferred embodiment, the nail-holding assembly 20 is rotatably attached to the second stationary mounting bar 19 by a threaded pivot pin 26. The pivot pin 26 extends all the way through the nail-holding assembly 20 and through the positioning hole 192 located in the center of the generally tapered or rounded, semi-circular distal end 191 of the second stationary mounting bar 19. The pivot pin 26 screws into a pivot pin cap 261 so as to securely fasten the nail-holding assembly 20 to the second stationary mounting bar 19 while still permitting the user to slidably rotate the nail-holding assembly 20 vertically around the second stationary mounting bar 19.

In such a configuration, the threaded pivot pin 26 is loosened so that the user can slidably rotate the nail-holding assembly 20 vertically to the desired angle. The user would then retighten the pivot pin 26 to prevent unwanted movement of the nail-holding assembly 20 while the user is hammering the nails 40 held therein. While the pivot pin 26 and the pivot pin cap 261 are typically composed of stainless steel, numerous alternative materials including, without limitation, chrome-plated metals, plastics, hardened rubber, and the like are also suitable alternatives.

There is another configuration of the preferred embodiment whereby the steps of loosening and then re-tightening the pivot pin 26 are not required. This configuration is identical to that found in the alternative (vertical rotation) embodiment. Referring to FIGS. 13, 13*a*, and 13*b*, the second stationary mounting bar 19 is solid and rectangular in shape with a rectangular cross section and a generally tapered or semi-circular, rounded distal end 191. A positioning hole 192 is located in the center of the distal end 191 to permit attaching the nail-holding assembly 20 to the second stationary mounting bar 19. A number of evenly-spaced grooves 193 extend radially outward from the periphery of the positioning hole 192 on both the right side 194 of the second stationary mounting bar 19 and also on the left side 195 of the second stationary mounting bar 19. The number and spacing of grooves 193 may vary from model to model but the number and spacing should be sufficient to permit incremental vertical movement of the nail-holding assembly 20 through an arc of at least 180 degrees.

The nail-holding assembly 20 for the preferred embodiment is exactly the same as it is for the alternative (vertical rotation) embodiment. Referring again to FIGS. 13 and 14 (and back to FIGS. 8 and 9) the nail-holding assembly 20 consists of two nail-holding plates 21 (211,212) separated by a U-shaped elastic separator 22 with a tightening hole 222 located in each separator leg 221. The inherent elasticity in the material constituting the separator 22 tends to move the nail-holding plates 21 (211,212) apart. As such, materials such as, without limitation, stainless steel, a hardened rubber, or a hard, resilient plastic would be suitable for materials making up the separator 22.

The nail-holding plates 21 (211,212) are typically composed of a lightweight, durable, and non-deformable material such as a hard rubber or plastic compound, nylon, aluminum, composite material, and the like. The nail-holding plates 21 (211,212) are rectangular in shape with a generally tapered or semi-circular rounded proximal end 213 and an angled or vertical distal end 214. The tapered or rounded proximal end 213 permits vertical rotation of the nail-holding assembly 20 without hitting the distal end 185 of the movable mounting bar 18.

Each nail-holding plate 21 (211,212) has an inner surface 216 and an outer surface 217. Each nail-holding plate 21 (211,212) has a positioning hole 24 located in the center of the tapered or rounded proximal end 213 to permit attaching the nail-holding assembly 20 to the second stationary mounting bar 19. Similarly, each nail-holding plate 21 (211,212) has a tightening hole 28 near the distal end 214 through which a tightening pin 23 is inserted to permit the user to securely tighten the nail-holding plates 21 (211,212) around a nail 40 or a nail strip 41.

On the inner surface 216 of each nail-holding plate 21 (211,212), a series of raised positioning notches 25 extend radially outward from the periphery of the positioning hole 24. The positioning notches 25 are dimensioned to fit snugly into the grooves 193 located on the right side 194 and the left side 195 of the second stationary mounting bar 19. The number of positioning notches 25 may vary. A single positioning notch 25 is sufficient to slip into a single groove 193 and thereby hold the nail-holding assembly 20 at the desired vertical angle while the user hammers the nails 40 into the receiving surface. Two positioning notches 25 directly opposite one another provide an additional measure of security against inadvertent slippage of the nail-holding assembly 20. Similarly, four positioning notches 25 positioned 90 degrees apart (as shown in FIGS. 8 and 9) provide even more security against inadvertent slippage.

A threaded tightening pin 23 extends all the way through the left nail-holding plate 211 near its distal end 214, through both separator legs 221, through the right nail-holding plate 212 near its distal end 214, and screws into a tightening pin cap 231 so as to draw the nail-holding plates 21 (211, 212) together. While the tightening pin 23 and the tightening pin cap 231 are typically composed of stainless steel, numerous alternative materials including, without limitation, chrome-plated metals, plastics, hardened rubber, and the like are also suitable alternatives.

A gripping surface 215 on the inside of each nail-holding plate's 21 (211,212) distal end 214 securely holds the nail 40 or the nail strip 41 so that the nail 40 or the nail strip 41 will not fall out of the nail-holding plates 21 (211,212). The gripping surface is typically a groove or other such indentation that has been machined or cut into the inner surface 216 of each nail holding plate's 21 (211,212) distal end 214.

The preferred embodiment also contemplates the optional use of a wavy washer 27 inserted between the pivot pin 26 and the outer surface 217 of the left nail-holding plate 211 and another wavy washer 27 inserted between the pivot pin cap 261 and the outer surface 217 of the right nail-holding plate 212. The wavy washers 27 are positioned concavely on the outer surface 217 of each nail-holding plate 21 (211,212) to facilitate removal of the pivot pin 26 and the pivot pin cap 261 when necessary.

Typically, a carpenter will position nails 40 at a 90 degree angle (perpendicular) to the surface into which they will be hammered. However, nails 40 mounted or otherwise disposed in a nail strip 41 are often mounted at an angle. To accommodate such a configuration, the distal end 214 will be angled as shown in FIGS. 8, 9 and 10 so as to vertically align nails 40 that are angularly disposed in a nail strip 41. The present invention can also be constructed to accommodate nails 40 that are vertically disposed in a nail strip 41 by casting the distal end 214 vertically as shown in FIG. 13.

Accordingly, the user, as with the simplest embodiment, positions and hammers a single nail 40 or a multiplicity of nails 40 held in a nail strip 41 beyond arm's length. Further, the user can now rotate the nail-holding assembly 20 horizontally through at least a 180 degree arc to reach angular surfaces at the same extended distance. Further still, the user can now also rotate the nail holding assembly 20 vertically through at least a 180 degree arc to reach angular surfaces at the same extended distance.

Operation—Simplest Embodiment

In operation, the simplest embodiment affords the user the ability to hammer a multiplicity of nails 40. Referring to FIGS. 1-4, the user would loosen (unscrew) the tightening pin 23 from the tightening pin cap 231 whereby the elastic separator legs 221 would push the nail-holding plates 21 (211, 212) apart. Because the separator 22 is composed of an elastic material, loosening the tightening pin 23 reduces the compressive force on the separator 22 which moves the nail-holding plates 21 apart as the separator 22 tries to return to its resting state. The user would then insert a single nail 40 or a breakable nail strip 41 holding a multiplicity of nails 40 into the nail gripping surface 215. The nail gripping surface 215, as stated previously, is typically a groove or other such indentation that has been machined or cut into the inside of each nail-holding plate's 21 (211,212) distal end 214 so as to fit snugly around a single nail 40 or the last (closest to the user) nail 40 in a commercially available breakable nailing strip 41. The user then tightens (screws) the tightening pin 23 back into the tightening pin cap 231 which would move the nail-holding plates 21 (211,212) towards one another until the gripping surface 215 is tightly around the nail 40 or the last nail 40 in a breakable nail strip 41.

The user would then hold the device at arm's length to position and hammer a single nail 40 or a multiplicity of nails 40 held in a nail strip 41. When using the breakable nail strip 41, the user would position the outermost nail 40 in the desired position and begin hammering. As the nail is being driven into the desired surface, the user's hammer will break that portion of the nail strip 41 holding the outermost nail 40 while leaving the remainder of the nail strip 41 intact so that the user may position the next outmost nail 40 in the desired location without having to reload the nail-holding assembly 20 as would be the case with the devices disclosed by the prior art.

Operation—Alternative Embodiments

In operation, the alternative embodiments afford the user the user the ability to hammer a multiplicity of nails 40 and position the nail-holding assembly 20 horizontally or vertically with respect to the handle 11. Referring to FIGS. 5-13, the user would insert the nail 40 or the nail strip 41 into the nail-holding assembly in the same manner as described for the simplest embodiment above.

To rotate the nail-holding assembly 20 horizontally, the user would simply loosen (unscrew) the pivot pin 26 from the pivot pin cap 261 and then slidably rotate the nail-holding assembly 20 horizontally to the desired position. The user would then tighten the pivot pin 26 into the pivot pin cap 261 until the stationary mounting bar 14 and the horizontal inner surfaces 216 of the U-shaped block 180 (horizontal movement alternative) are tightly pressed together rendering the nail-holding assembly 20 immovable.

To rotate the nail-holding assembly 20 vertically, the user would simply loosen (unscrew) the pivot pin 26 from the pivot pin cap 261 and then slidably rotate the nail-holding assembly 20 vertically to the desired position. The user would then tighten the pivot pin 26 into the pivot pin cap 261 until the stationary mounting bar 14 and the nail-holding plate inner surfaces 216 (vertical movement alternative) are tightly pressed together rendering the nail-holding assembly 20 immovable.

In the variants using grooves 17 and positioning notches 25, the user would simply apply horizontal pressure to the nail-holding assembly 20 (horizontal rotation embodiment) and incrementally rotate it horizontally until the desired location is reached. Similarly, the user would simply apply vertical pressure to the nail-holding assembly 20 (vertical rotation embodiment) and incrementally rotate it vertically until the desired location is reached. The pressure causes the positioning notch 25 to slip out of its groove 17 and rotate in the direction of the applied pressure until it slips into the next adjacent groove 17. The nail-holding assembly 20 remains fixed in this position unless the user continues to apply pressure, which moves the positioning notch 25 into the next adjacent groove 17. The user repeats this process until the nail-holding assembly 20 is at the desired (horizontal or vertical) angle from the handle 11.

The user would then hold the device at arm's length to position and hammer a single nail 40 or a multiplicity of nails 40 held in a nail strip 41. When using the breakable nail strip 41, the user would position the outermost nail 40 in the desired position and begin hammering. As the nail is being driven into the desired surface, the user's hammer will break that portion of the nail strip 41 holding the outermost nail 40 while leaving the remainder of the nail strip 41 intact so that the user may position the next outmost nail 40 in the desired location.

Operation—Preferred Embodiment

In operation, the preferred embodiment affords the user the user the ability to hammer a multiplicity of nails 40 and position the nail-holding assembly 20 horizontally and/or or vertically with respect to the handle 11. Referring to FIGS. 13 and 14, the user would insert the nail 40 or the nail strip 41 into the nail-holding assembly 20 in the same manner as described for the simplest embodiment above.

To rotate the nail-holding assembly 20 vertically, the user would simply loosen (unscrew) the pivot pin 26 from the pivot pin cap 261 and then slidably rotate the nail-holding assembly 20 vertically around the second stationary mounting bar 19 to the desired position. The user would then tighten the pivot pin 26 into the pivot pin cap 261 until the second stationary mounting bar 19 and the nail-holding plate inner surfaces 216 are tightly pressed together rendering the nail-holding assembly 20 immovable. Similarly, to rotate the movable mounting bar 18 horizontally, the user would loosen (unscrew) the pivot pin 26 from the pivot pin cap 261 and then slidably rotate the movable mounting bar 18 horizontally around the stationary mounting bar 14 to the desired position. The user would then tighten the pivot pin 26 into the pivot pin cap 261 until the stationary mounting bar 14 and both horizontal inner surfaces 216 on the movable mounting bar 18 are tightly pressed together rendering the movable mounting bar 18 immovable in a horizontal direction.

In the variants using grooves 17, 193 and positioning notches 25, 188 the user would simply apply horizontal pressure to the movable mounting bar 18 and incrementally rotate the movable mounting bar 18 horizontally until the desired location is reached. Similarly, the user would simply apply vertical pressure to the nail-holding assembly 20 and incrementally rotate it vertically until the desired location is reached.

Applying horizontal or vertical pressure causes the positioning notch 25, 188 to slip out of its groove 17, 193 and rotate in the direction of the applied pressure until it slips into the next adjacent groove 17. The nail-holding 20 assembly remains fixed in this position unless the user continues to apply pressure, which moves the positioning notch 25,188 into the next adjacent groove 17, 193. The user repeats this process until the movable mounting bar 18 or the nail-holding assembly 20 is at the desired (horizontal or vertical) angle from the handle 11.

The user would then hold the device at arm's length to position and hammer a single nail 40 or a multiplicity of nails 40 held in a nail strip 41. When using the breakable nail strip 41, the user would position the outermost nail 40 in the desired position and begin hammering. As the nail is being driven into the desired surface, the user's hammer will break that portion of the nail strip 41 holding the outermost nail 40 while leaving the remainder of the nail strip 41 intact so that the user may position the next outmost nail 40 in the desired location.

CONCLUSIONS, RAMIFICATIONS, AND SCOPE

The present invention is an improved nail holder that allows the user to safely and comfortably hold a multiplicity of nails so as to extend his or her reach into hard-to-reach or otherwise inaccessible places. Four embodiments have been disclosed with successive embodiments offering the user more flexibility in accessing hard-to-reach places when hammering.

All embodiments have a handle assembly 10 and a closeable nail-holding assembly 20. All embodiments have a solid, uniformly-cast handle 11 that is either cylindrical in shape (straight with a circular cross-section) or curved with an oval-shaped cross-section. While the length of the handle 11 can vary from user to user, an overall length in the range of 10 inches to 16 inches is considered optimal. A handle 11 as short as four inches might also be desirable to simply position a single nail 40 or a multiplicity of nails 40 just beyond the reach of the user while affording the user more control over the positioning of the nails 40.

The nail-holding assembly 20 in all embodiments consists of two parallel, uniformly-cast, generally rectangular nail-holding plates 21 held apart by an elastic separator 22 and each fitted with a gripping surface 215 at their distal ends 214 that will securely hold a single nail 40 or a nail 40 positioned with a multiplicity of nails 40 in a breakable nail strip 41. The nail-holding plates 21 are typically composed of a lightweight, durable, and non-deformable material such as a hard rubber or plastic compound, nylon, aluminum, composite material, and the like.

All embodiments utilize a threaded tightening pin 23 that screws into a tightening pin cap 231 to move the nail-holding plates 21 together. All embodiments use either a threaded attaching pin 15 that screws into an attaching pin cap 151 or a threaded pivot pin 26 that screws into a pivot pin cap 261 to attach the nail-holding assembly 20 to the handle assembly. While the attaching pin 15, the attaching pin cap 151, the tightening pin 23, the tightening pin cap 231, the pivot pin 26, and the pivot pin cap 261 are typically composed of stainless steel, numerous alternative materials including, without limitation, chrome-plated metals, plastics, hardened rubber, and the like are also suitable alternatives.

The present invention represents a significant improvement over the inventions disclosed in the prior art by:

(1) Holding a multiplicity of nails at the same time.
(2) Providing the user with an ergonomic handle that is comfortable, efficient and safe to hold.
(3) Extending the reach of the user beyond arm's length.
(4) Extending the reach of the user into hard-to-reach places.
(5) Moving the held nails horizontally and/or vertically so as to permit operation in hard-to-reach or otherwise inaccessible places.

These improvements provide the user with a device that is easier to operate and more affordable than similar devices disclosed by the prior art. The present invention is simple in design and construction which makes it easy to use and economical to manufacture. The present invention uses many off-the-shelf components, which, again, makes it economical to manufacture. The present invention is adaptable to nails of all sizes and types that are made from ferrous, magnetic, or other such materials. The present invention can be used to drive nails into any nailable material at any angle and from any direction.

What is claimed is:

1. A multiple nail holder-extension comprising:

a. a handle assembly, said handle assembly having
(1) a uniformly solid handle with a proximal end and a distal end,
(2) a solid, generally rectangular stationary mounting bar having a rectangular cross-section and extending perpendicularly from said distal end of said handle, said stationary mounting bar having a proximal end adjacent to said distal end of said handle, and a generally tapered or rounded distal end with a positioning hole centered therein;

b. a closable nail-holding assembly, said nail-holding assembly having:
(1) two uniformly cast, solid, generally rectangular nail-holding plates in parallel alignment, each of said nail-holding plates having a rectangular cross section and each of said nail-holding plates having an inner surface, an outer surface, a vertical proximal end, and an angled or vertical distal end with a tightening hole therein,
(2) a U-shaped elastic separator inserted or embedded between said nail-holding plates near said distal ends of said nail holding plates, said separator having a tightening hole through each of its legs,
(3) a threaded tightening pin extending through said tightening holes in said nail-holding plates and through said tightening holes in said separator,
(4) a tightening pin cap positioned on said outer surface of one of said nail-holding plates, said tightening pin cap configured to screw on to said tightening pin,
(5) a gripping surface molded with, cut into, cast on, or extruded from said inner surfaces of both said nail-holding plates at said distal ends of said nail-holding plates, said gripping surfaces dimensioned to hold a single nail or a nail positioned in a breakable nail strip holding a multiplicity of evenly-spaced nails; and, c. a means for fixably attaching said nail-holding assembly to said distal end of said stationary mounting bar.

2. The multiple nail holder-extension according to claim 1 wherein said means consists of casting, molding, or extruding said handle and said stationary mounting bar as a single piece.

3. The multiple nail holder-extension according to claim 2 wherein said handle is curved and has a generally oval-shaped cross section.

4. The multiple nail holder-extension according to claim 1 wherein said means consists of physically inserting said stationary mounting bar perpendicularly into said distal end of said handle.

5. The multiple nail holder-extension according to claim 4 wherein said handle is curved and has a generally oval-shaped cross section.

6. The multiple nail holder-extension according to claim 1 wherein said means comprises of:

a. a threaded attaching pin extending through said stationary mounting bar and through said proximal ends of said nail-holding plates, said nail-holding plates being positioned in parallel alignment on opposite sides of said stationary mounting bar; and b. a threaded attaching pin cap, said attaching pin cap configured to screw on to said threaded attaching pin.

7. The multiple nail holder-extension according to claim 6 wherein said handle is curved and has a generally oval-shaped cross section.

8. The multiple nail holder-extension according to claim 1 wherein said handle has an overall length of ten to sixteen inches.

9. An adjustable multiple nail holder-extension comprising:

a. a handle assembly, said handle assembly having:

(1) a uniformly solid handle with a proximal end and a distal end, (2) a solid, horizontally aligned, generally rectangular stationary mounting bar with a rectangular cross-section and extending perpendicularly from said distal end of said handle, said stationary mounting bar having an upper surface, a lower surface, a proximal end, a generally tapered or rounded distal end with a positioning hole centered therein;

b. a closable nail-holding assembly, said nail-holding assembly consisting of:

(1) a solid, U-shaped block of uniform composition and having a flat distal end, a generally tapered or rounded proximal end with a positioning hole centered therein, and a box-shaped, horizontally aligned, hollow slot cut into said distal end, said slot having two horizontal surfaces and dimensioned to fit snugly over said stationary mounting bar, (2) two uniformly cast, solid, generally rectangular nail-holding plates extending perpendicularly and in parallel alignment from said distal end of said block, each of said nail-holding plates being of rectangular cross section and each of said nail-holding plates having an inner surface, an outer surface, a generally tapered or rounded proximal end with a positioning hole centered therein, and an angled or vertical distal with a tightening hole therein, (3) a U-shaped elastic separator inserted or embedded between said nail-holding plates near said distal ends of said nail-holding plates, said separator having a tightening hole through each of its legs, (4) a threaded tightening pin extending through said tightening holes in said nail-holding plates and through said tightening holes in said separator, (5) a threaded tightening pin cap positioned on said outer surface of one of said nail-holding plates, said tightening pin cap configured to screw on to said tightening pin, (6) a gripping surface molded with, cut into, cast on, or extruded from said inner surfaces of both said nail-holding plates at said distal ends of said nail-holding plates, said gripping surfaces dimensioned to hold a single nail or a nail positioned in a breakable nail strip holding a multiplicity of evenly-spaced nails; and c. a means for movably attaching said nail-holding assembly to said handle assembly so as to permit horizontal rotation of said nail-holding assembly with respect to said handle.

10. The adjustable multiple nail holder-extension according to claim 9 wherein said means consists of:

a. a threaded pivot pin extending through said proximal end of said block and through said positioning hole in stationary mounting bar; and b. a threaded pivot pin cap dimensioned to screw on to said threaded attaching pin so as to permit horizontal rotation of said nail-holding assembly when loose and to securely fasten said nail-holding assembly to said stationary mounting bar when tightened.

11. The adjustable multiple nail holder-extension according to claim 10 wherein said handle is curved and has a generally oval-shaped cross section.

12. The adjustable multiple nail holder-extension according to claim 9 wherein said means consists of:

a. a plurality of grooves located on said upper surface and said lower surface of said stationary mounting bar, said grooves extending radially outward from said positioning hole in said distal end of said stationary mounting bar;

b. one to four raised notches located on each of said horizontal surfaces on said block, said notches extending radially outward from said positioning hole in said proximal end of said block and dimensioned to fit snugly into said grooves on said stationary mounting bar;

c. a threaded pivot pin extending through said proximal end of said block and through said stationary mounting bar; and d. a threaded pivot pin cap dimensioned to screw on to said threaded attaching pin so as to securely fasten said nail-holding assembly to said stationary mounting bar while still permitting incremental horizontal rotation of said nail-holding assembly as said notches move into said grooves incrementally when horizontal pressure is applied to said nail-holding assembly.

13. The adjustable multiple nail holder-extension according to claim 12 wherein said handle is curved and has a generally oval-shaped cross section.

14. The adjustable multiple nail holder-extension according to claim 9 wherein said handle has an overall length of ten to sixteen inches.

15. An adjustable multiple nail holder-extension comprising:

a. a handle assembly, said handle assembly having:

(1) a uniformly solid handle with a proximal end and a distal end, (2) a solid, vertically aligned, generally rectangular stationary mounting bar having a rectangular cross-section and extending perpendicularly from said distal end of said handle, said stationary mounting bar having a right side, a left side, a proximal end adjacent to said distal end of said handle, a generally tapered or rounded distal end with a positioning hole centered therein;

b. a closable nail-holding assembly, said nail-holding assembly having:

(1) a uniformly cast, solid, generally rectangular left nail-holding plate with a rectangular cross section, said left nail-holding plate positioned adjacent to said left side of said stationary mounting bar so as to extend outward therefrom and said left nail-holding plate also having an inner surface, an outer surface, a generally tapered or rounded proximal end with a positioning hole centered therein, and an angled or vertical distal end with a tightening hole therein, (2) a uniformly cast, solid, generally rectangular right nail-holding plate with a rectangular cross section, said right nail-holding plate positioned adjacent to said right side of said stationary mounting bar so as to extend outward therefrom in parallel alignment with said left nail-holding plate, said right nail-holding plate also having an inner surface, an outer surface, a generally tapered or rounded proximal end with a positioning hole centered therein, and an angled or vertical distal end, with a tightening hole therein, (3) a U-shaped elastic separator inserted or embedded between said left nail-holding plate and said right nail-holding plate near said distal ends of said nail-holding plates, said separator having a tightening hole through each of its legs, (4) a threaded tightening pin extending through said left nail-holding plates, said separator, and said right nail-holding plate, (5) a threaded tightening pin cap positioned on said outer surface of said right nail-holding plate and dimensioned to screw on to said tightening pin, (6) a gripping surface molded with, cut into, or cast on said inner surface of both said left nail-holding plate and said right nail-holding plate at said distal ends of said nail-holding plates, said gripping surfaces dimensioned to fit snugly around a single nail or a nail positioned in a breakable nail strip holding a multiplicity of evenly-spaced nails when said nail holding plates are moved towards each other; and c. a means for movably attaching said nail-holding assembly to said handle assembly so as to permit vertical rotation of said nail-holding assembly with respect to said handle.

16. The adjustable multiple nail holder-extension according to claim 15 wherein said handle is curved and has a generally oval-shaped cross section.

17. The adjustable multiple nail holder-extension according to claim 15 wherein said means consists of:

a. a threaded pivot pin extending through said positioning hole in said proximal end of said left nail-holding plate, through said positioning hole in said stationary mounting bar, and through said positioning hole in said proximal end of said right nail-holding plate; and b. a threaded pivot pin cap dimensioned to screw on to said threaded attaching pin so as to permit vertical rotation of said nail-holding assembly when loose and to securely fasten said nail-holding plate to said stationary mounting bar when tightened.

18. The multiple nail holder-extension according to claim 17 wherein said handle is curved and has a generally oval-shaped cross section.

19. The adjustable multiple nail holder-extension according to claim 15 wherein said means consists of:

a. a plurality of grooves located on said left hand side and said right hand side of said stationary mounting bar, said grooves extending radially outward from said positioning hole in said distal end of said stationary mounting bar, b. one to four raised notches on each of said nail-holding plate's inner surface, said notches extending radially outward from said positioning hole in said proximal end of said left nail-holding plate and said right nail-holding plate, said notches dimensioned to fit snugly into said grooves on said stationary mounting bar;

c. a threaded pivot pin extending through said positioning hole in said proximal end of said left nail-holding plate, through said positioning hole in said z stationary mounting bar, and through said positioning hole in said proximal end of said right nail-holding plate; and d. a threaded pivot pin cap dimensioned to screw on to said threaded pivot pin so as to securely fasten said nail-holding plate to said stationary mounting bar while still permitting incremental vertical rotation of said nail-holding assembly as said notches move into said grooves incrementally as vertical pressure is applied to said nail-holding assembly.

20. The adjustable multiple nail holder-extension according to claim 19 wherein said handle is curved and has a generally oval-shaped cross section.

21. The adjustable multiple nail holder-extension according to claim 15 wherein said handle has an overall length of ten to sixteen inches.

22. An adjustable multiple nail holder-extension comprising:

a. a handle assembly, said handle assembly having:

(1) a uniformly solid handle with a proximal end and a distal end, (2) a solid, horizontally aligned, generally rectangular stationary mounting bar having a rectangular cross-section and extending perpendicularly from said distal end of said handle, said stationary mounting bar having an upper surface, a lower surface, a proximal end adjacent to said distal end of said handle, a generally tapered or rounded distal end with a positioning hole centered therein;

b. a solid, U-shaped movable mounting bar of uniform composition, said movable mounting bar having:

(1) a generally tapered or rounded proximal end, (2) a horizontal, box-shaped hollow slot cut into said proximal end, said slot having two horizontal surfaces and dimensioned to fit snugly over said stationary mounting bar, (3) a flat distal end, (4) a solid, vertically aligned, generally rectangular second stationary mounting bar having a rectangular cross-section and extending perpendicularly from said distal end of said movable mounting bar, said second stationary mounting bar having a right side, a left side, a proximal end, a generally tapered or rounded distal end with a positioning hole centered therein;

c. a means for movably attaching said movable mounting bar to said stationary mounting bar so as to permit horizontal rotation of said movable mounting bar with respect to said handle;

d. a closable nail-holding assembly, said nail-holding assembly having:

(1) a uniformly cast, solid, generally rectangular left nail-holding plate with a rectangular cross section, said left nail-holding plate positioned adjacent to said left side of said second stationary mounting bar so as to extend outward therefrom, said left nail-holding plate also having an inner surface, an outer surface, a generally tapered or rounded proximal end with a positioning hole centered therein, and an angled or vertical distal end, with a tightening hole therein, (2) a uniformly cast, solid, generally rectangular right nail-holding plate with a rectangular cross section, said right nail-holding plate positioned adjacent to said right side of said second stationary mounting bar so as to extend outward therefrom in parallel alignment with said left nail-holding plate, said right nail-holding plate also having an inner surface, an outer surface, a generally tapered or rounded proximal end with a positioning hole centered therein, and an angled or vertical distal end with a tightening hole therein, (3) a U-shaped elastic separator inserted or embedded between said left nail-holding plate and said right nail-holding plate near said distal ends of said nail-holding plates, said separator having a tightening hole through each of its legs, (4) a threaded tightening pin extending through said tightening hole in said left nail-holding plate, through said tightening holes in said separator, and through said tightening hole in said right nail-holding plate, (5) a threaded tightening pin cap positioned on said outer surface of said right nail-holding plate and dimensioned to screw on to said tightening pin, (6) a gripping surface molded with, cut into, or cast on said inner surface of both said left nail-holding plate and said right nail-holding plate at said distal ends of said nail-holding plates, said gripping surfaces dimensioned to fit snugly around a single nail or a nail positioned in a breakable nail strip holding a multiplicity of evenly-spaced nails when said nail-holding plates are moved towards each other; and e. a means for movably attaching said nail-holding assembly to said second stationary mounting bar so as to permit vertical rotation of said nail-holding assembly with respect to said movable mounting bar and said handle.

23. The multiple nail holder-extension according to claim 22 wherein said handle is curved and has a generally oval-shaped cross section.

24. The multiple nail holder-extension according to claim 22 wherein:

a. said means for movably attaching said movable mounting bar to said stationary mounting bar so as to permit horizontal rotation of said movable mounting bar with respect to said handle consists of:

(1) a threaded pivot pin extending through said positioning hole in said stationary mounting bar and through said positioning hole in said proximal end of said movable mounting bar, (2) a threaded pivot pin cap dimensioned to screw on to said threaded attaching pin so as to permit horizontal rotation of said movable mounting bar when loose and to securely fasten said movable mounting bar to said stationary mounting bar when tightened; and b. said means for movably attaching said nail-holding assembly to said second stationary mounting bar so as to permit vertical rotation of said nail-holding assembly with respect to said movable mounting bar and said handle consists of:

(1) a threaded pivot pin extending through said positioning hole in said proximal end of said left nail-holding plate, through said positioning hole in said second stationary mounting bar, and through said positioning hole in said proximal end of said right nail-holding plate, (2) a threaded pivot pin cap dimensioned to screw on to said threaded pivot pin so as to permit vertical rotation of said nail-holding assembly when loose and to securely fasten said nail-holding plate to said second stationary mounting bar when tightened.

25. The adjustable multiple nail holder-extension according to claim 24 wherein said handle is curved and has a generally oval-shaped cross section.

26. The adjustable multiple nail holder-extension according to claim 22 wherein said means for movably attaching said movable mounting bar to said stationary mounting bar so as to permit horizontal rotation of said movable mounting bar with respect to said handle consists of:

a. a plurality of grooves located on said upper surface and said lower surface of said stationary mounting bar, said grooves extending radially outward from said positioning hole in said distal end of said stationary mounting bar;

b. one to four raised notches located on each horizontal surface of said slot in said movable mounting bar, said notches extending radially outward from said positioning hole in said proximal end of said movable mounting bar and dimensioned to fit snugly into said grooves on said stationary mounting bar;

c. a threaded pivot pin extending through said positioning hole in said stationary mounting bar and through said positioning hole in said proximal end of said block, d. a threaded pivot pin cap dimensioned to screw on to said threaded pivot pin so as to securely fasten said nail-holding plate to said stationary mounting bar while still permitting incremental horizontal rotation of said nail-holding assembly as said notches move into said grooves incrementally as horizontal pressure is applied to said nail-holding assembly; and wherein said means for movably attaching said nail-holding assembly to said second stationary mounting bar so as to permit vertical rotation of said nail holding assembly with respect to said movable mounting bar and said handle consists of:

a. a plurality of grooves located on said left hand side and said right hand side of said second stationary mounting bar, said grooves extending radially outward from said positioning hole in said distal end of said second stationary mounting bar;

b. one to four raised notches located on each of said nail-holding plate's said inner surface, said notches extending radially outward from said positioning hole in said proximal end of said left nail-holding plate and said right nail-holding plate, said notches dimensioned to fit snugly into said grooves on said second stationary mounting bar;

c. a threaded pivot pin extending through said positioning hole in said proximal end of said left nail-holding plate, through said positioning hole in said second stationary mounting bar, and through said positioning hole in said proximal end of said right nail-holding plate; and d. a threaded pivot pin cap dimensioned to screw on to said threaded pivot pin so as to securely fasten said nail-holding plate to said second stationary mounting bar while still permitting incremental vertical rotation of said nail-holding assembly as said notches move into said grooves incrementally as vertical pressure is applied to said nail-holding assembly.

27. The adjustable multiple nail holder-extension according to claim 26 wherein said handle is curved and has a generally oval-shaped cross section.

28. The adjustable multiple nail holder-extension according to claim 22 wherein said handle has an overall length of ten to sixteen inches.

* * * * *